US011510306B2

(12) United States Patent
Ru

(10) Patent No.: US 11,510,306 B2
(45) Date of Patent: Nov. 22, 2022

(54) SYSTEMS AND METHODS FOR IMPROVED X-RAY TUBE LIFE

(71) Applicant: Hologic, Inc., Marlborough, MA (US)

(72) Inventor: Guoyun Ru, Danbury, CT (US)

(73) Assignee: Hologic, Inc., Marlborough, MA (US)

( * ) Notice: Subject to any disclaimer, the term of this patent is extended or adjusted under 35 U.S.C. 154(b) by 0 days.

(21) Appl. No.: 17/111,764

(22) Filed: Dec. 4, 2020

(65) Prior Publication Data

US 2021/0176850 A1 Jun. 10, 2021

Related U.S. Application Data

(60) Provisional application No. 62/944,126, filed on Dec. 5, 2019.

(51) Int. Cl.
*H01J 35/14* (2006.01)
*H05G 1/02* (2006.01)
(Continued)

(52) U.S. Cl.
CPC ..... *H05G 1/02* (2013.01); *H01J 35/066* (2019.05); *H05G 1/58* (2013.01)

(58) Field of Classification Search
CPC ..... H01J 1/15; H01J 35/064; H01J 35/066; H01J 35/147; H01J 35/153; H01J 2235/068; H01J 35/06; H01J 35/045; H01J 35/18; H01J 35/116; H01J 35/12; H01J 2235/1295; H01J 35/112; H01J 35/13; H01J 35/14; H01J 2235/1262; H01J 2235/163; H01J 2235/06; H01J 3/06; H01J 19/42; H01J 37/065; H01J 19/10; H01J 29/50; H05G 1/02; H05G 1/58; H05G 1/70; H05G 1/06; H05G 1/52; H05G 1/54; H05G 1/40;
(Continued)

(56) References Cited

U.S. PATENT DOCUMENTS 3,365,575 A 1/1968 Strax
3,502,878 A 3/1970 Stewart
(Continued)

FOREIGN PATENT DOCUMENTS

CN 108492874 9/2018
DE 4104166 8/1992
(Continued)

OTHER PUBLICATIONS

"Essentials for life: Senographe Essential Full-Field Digital Mammography system", GE Health-care Brochure, MM-0132-05.06-EN-US, 2006, 12 pgs.
(Continued)

*Primary Examiner* — Irakli Kiknadze
(74) *Attorney, Agent, or Firm* — Merchant & Gould P.C.

(57) ABSTRACT

An x-ray tube having at least one focusing cup and an anode. The x-ray tube may have a first filament positioned in a first location between the focusing cup and the anode, the first filament having a first size, and a second filament positioned in a second location between the focusing cup and anode, the second filament having a second size that is substantially the same as the first size. The x-ray tube may also include a switching mechanism configured to engage the second filament upon failure of the first filament.

15 Claims, 8 Drawing Sheets

(51) Int. Cl.
*H01J 35/06* (2006.01)
*H05G 1/58* (2006.01)

(58) Field of Classification Search
CPC ..... H05G 1/46; H05G 1/32; H05G 1/025; H05G 1/30; H01L 21/02164; H01L 21/02178; H01L 21/02181; H01L 21/02554; H01L 21/0259; H01L 45/08; H01L 45/085; H01L 45/1233; H01L 45/1246; H01L 45/146; H01L 45/1608; H05B 41/2883; H05B 41/2887; H05B 41/3928; G01T 7/005; A61B 6/582; A61B 6/032; A61B 6/40; A61B 6/461; A61B 6/54
USPC ..... 378/119, 123, 134, 136–138
See application file for complete search history.

(56) References Cited

U.S. PATENT DOCUMENTS 3,863,073 A 1/1975 Wagner
3,971,950 A 7/1976 Evans et al.
4,160,906 A 7/1979 Daniels et al.
4,310,766 A 1/1982 Finkenzeller et al.
4,334,153 A * 6/1982 Stehman ..... H05G 1/52 378/91
4,380,086 A 4/1983 Vagi
4,496,557 A 1/1985 Malen et al.
4,513,433 A 4/1985 Weiss et al.
4,542,521 A 9/1985 Hahn et al.
4,559,641 A 12/1985 Caugant et al.
4,662,379 A 5/1987 Macovski
4,706,269 A 11/1987 Reina et al.
4,721,856 A 1/1988 Saotome et al.
4,744,099 A 5/1988 Huettenrauch et al.
4,752,948 A 6/1988 MacMahon
4,760,589 A 7/1988 Siczek
4,763,343 A 8/1988 Yanaki
4,773,086 A 9/1988 Fujita et al.
4,773,087 A 9/1988 Plewes
4,799,248 A * 1/1989 Furbee ..... H01J 35/066 378/114
4,819,258 A 4/1989 Kleinman et al.
4,821,727 A 4/1989 Levene et al.
4,901,335 A 2/1990 Ferlic
4,969,174 A 11/1990 Scheid et al.
4,989,227 A 1/1991 Tirelli et al.
4,998,270 A 3/1991 Scheid et al.
5,018,176 A 5/1991 Romeas et al.
RE33,634 E 7/1991 Yanaki
5,029,193 A 7/1991 Saffer
5,051,904 A 9/1991 Griffith
5,078,142 A 1/1992 Siczek et al.
5,129,911 A 7/1992 Siczek et al.
5,142,557 A 8/1992 Toker
5,163,075 A 11/1992 Lubinsky et al.
5,164,976 A 11/1992 Scheid et al.
5,199,056 A 3/1993 Darrah
5,212,637 A 5/1993 Saxena
5,219,351 A 6/1993 Teubner
5,240,011 A 8/1993 Assa
5,256,370 A 10/1993 Slattery et al.
5,274,690 A 12/1993 Burke
5,289,520 A 2/1994 Pellegrino et al.
5,291,539 A 3/1994 Thumann et al.
5,313,510 A 5/1994 Ebersberger
5,359,637 A 10/1994 Webber
5,365,562 A 11/1994 Toker
5,415,169 A 5/1995 Siczek et al.
5,426,685 A 6/1995 Pellegrino et al.
5,451,789 A 9/1995 Wong
5,452,367 A 9/1995 Bick et al.
5,479,927 A 1/1996 Shmulewitz
5,483,072 A 1/1996 Coe
5,506,877 A 4/1996 Niklason et al.
5,526,394 A 6/1996 Siczek et al.
5,528,658 A 6/1996 Hell
5,539,797 A 7/1996 Heidsieck et al.
5,553,111 A 9/1996 Moore et al.
5,592,562 A 1/1997 Rooks
5,594,769 A 1/1997 Pellegrino et al.
5,596,200 A 1/1997 Sharma et al.
5,598,454 A 1/1997 Franetzke et al.
5,606,589 A 2/1997 Pellegrino et al.
5,609,152 A 3/1997 Pellegrino et al.
5,627,869 A 5/1997 Andrew et al.
5,657,362 A 8/1997 Giger et al.
5,668,844 A 9/1997 Webber
5,668,889 A 9/1997 Hara
5,706,327 A 1/1998 Adamkowski et al.
5,719,952 A 2/1998 Rooks
5,735,264 A 4/1998 Siczek et al.
5,769,086 A 6/1998 Ritchart et al.
5,773,832 A 6/1998 Sayed et al.
5,803,912 A 9/1998 Siczek et al.
5,818,898 A 10/1998 Tsukamoto et al.
5,828,722 A 10/1998 Ploetz et al.
5,841,829 A 11/1998 Dolazza
5,844,242 A 12/1998 Jalink, Jr.
5,844,965 A 12/1998 Galkin
5,864,146 A 1/1999 Karellas
5,872,828 A 2/1999 Niklason et al.
5,878,104 A 3/1999 Ploetz
5,896,437 A 4/1999 Ploetz
5,901,197 A 5/1999 Khutoryansky
5,930,330 A 7/1999 Wolfe
5,941,832 A 8/1999 Tumey et al.
5,970,118 A 10/1999 Sokolov
5,983,123 A 11/1999 Shmulewitz
5,986,662 A 11/1999 Argiro et al.
5,999,836 A 12/1999 Nelson et al.
6,005,907 A 12/1999 Ploetz
6,022,325 A 2/2000 Siczek et al.
6,075,879 A 6/2000 Roehrig et al.
6,081,577 A 6/2000 Webber
6,091,841 A 7/2000 Rogers et al.
6,101,236 A 8/2000 Wang et al.
6,137,527 A 10/2000 Abdel-Malek et al.
6,141,398 A 10/2000 He et al.
6,149,301 A 11/2000 Kautzer et al.
6,167,115 A 12/2000 Inoue
6,175,117 B1 1/2001 Komardin et al.
6,196,715 B1 3/2001 Nambu et al.
6,207,958 B1 3/2001 Giakos
6,216,540 B1 4/2001 Nelson et al.
6,219,059 B1 4/2001 Argiro
6,233,473 B1 5/2001 Shepherd et al.
6,243,441 B1 6/2001 Zur
6,244,507 B1 6/2001 Garland
6,256,369 B1 7/2001 Lai
6,256,370 B1 7/2001 Yavuz
6,269,176 B1 7/2001 Barski
6,272,207 B1 8/2001 Tang
6,282,264 B1 8/2001 Smith
6,289,235 B1 9/2001 Webber et al.
6,292,530 B1 9/2001 Yavus et al.
6,292,531 B1 9/2001 Hsieh et al.
6,293,282 B1 9/2001 Lemelson
6,327,336 B1 12/2001 Gingold et al.
6,341,156 B1 1/2002 Baetz et al.
6,345,194 B1 2/2002 Nelson et al.
6,375,352 B1 4/2002 Hewes et al.
6,399,951 B1 6/2002 Paulus
6,411,836 B1 6/2002 Patel et al.
6,415,015 B2 7/2002 Nicolas et al.
6,418,189 B1 7/2002 Schafer
6,442,288 B1 8/2002 Haerer et al.
6,459,925 B1 10/2002 Nields et al.
6,463,181 B2 10/2002 Duarte
6,480,565 B1 11/2002 Ning
6,490,476 B1 12/2002 Townsend et al.
6,496,557 B2 12/2002 Wilson
6,501,819 B2 12/2002 Unger et al.

(56) References Cited

U.S. PATENT DOCUMENTS 6,542,575 B1 4/2003 Schubert
6,553,096 B1 4/2003 Zhou et al.
6,556,655 B1 4/2003 Chichereau et al.
6,574,304 B1 6/2003 Hsieh et al.
6,574,629 B1 6/2003 Cooke, Jr. et al.
6,597,762 B1 7/2003 Ferrant et al.
6,611,575 B1 8/2003 Alyassin et al.
6,620,111 B2 9/2003 Stephens et al.
6,626,849 B2 9/2003 Huitema et al.
6,633,626 B2 10/2003 Trotter
6,633,674 B1 10/2003 Barnes et al.
6,638,235 B2 10/2003 Miller et al.
6,647,092 B2 11/2003 Eberhard et al.
6,674,835 B2 1/2004 Kaufhold
6,702,459 B2 3/2004 Barnes et al.
6,744,848 B2 6/2004 Stanton et al.
6,748,044 B2 6/2004 Sabol et al.
6,748,046 B2 6/2004 Thayer
6,748,047 B2 6/2004 Gonzalez
6,751,285 B2 6/2004 Eberhard et al.
6,758,824 B1 7/2004 Miller et al.
6,813,334 B2 11/2004 Koppe et al.
6,846,289 B2 1/2005 Besson
6,882,700 B2 4/2005 Wang et al.
6,885,724 B2 4/2005 Li et al.
6,895,076 B2 5/2005 Halsmer
6,901,132 B2 5/2005 Eberhard
6,909,790 B2 6/2005 Tumey et al.
6,909,792 B1 6/2005 Carrott et al.
6,912,319 B1 6/2005 Barnes et al.
6,931,093 B2 8/2005 Op De Beek et al.
6,940,943 B2 9/2005 Claus et al.
6,950,492 B2 9/2005 Besson
6,950,493 B2 9/2005 Besson
6,957,099 B1 10/2005 Arnone et al.
6,960,020 B2 11/2005 Lai
6,970,531 B2 11/2005 Eberhard et al.
6,970,586 B2 11/2005 Baertsch
6,978,040 B2 12/2005 Berestov
6,987,831 B2 1/2006 Ning
6,999,554 B2 2/2006 Mertelmeier
7,001,071 B2 2/2006 Deuringer
7,016,461 B2 3/2006 Rotondo
7,092,482 B2 8/2006 Besson
7,110,490 B2 9/2006 Eberhard et al.
7,110,502 B2 9/2006 Tsuji
7,116,749 B2 10/2006 Besson
7,123,684 B2 10/2006 Jing et al.
7,127,091 B2 10/2006 Op De Beek et al.
7,142,633 B2 11/2006 Eberhard et al.
7,190,758 B2 3/2007 Hagiwara
7,206,462 B1 4/2007 Betke
7,218,766 B2 5/2007 Eberhard
7,244,063 B2 7/2007 Eberhard
7,245,694 B2 7/2007 Jing et al.
7,263,214 B2 8/2007 Uppaluri
7,286,645 B2 10/2007 Freudenberger
7,302,031 B2 11/2007 Hjarn et al.
7,315,607 B2 1/2008 Ramsauer
7,319,734 B2 1/2008 Besson
7,319,735 B2 1/2008 Defreitas et al.
7,319,736 B2 1/2008 Rotondo
7,323,692 B2 1/2008 Rowlands et al.
7,331,264 B2 2/2008 Ozawa
7,356,113 B2 4/2008 Wu
7,430,272 B2 9/2008 Jing et al.
7,433,507 B2 10/2008 Jabri
7,443,949 B2 10/2008 Defreitas et al.
7,466,795 B2 12/2008 Eberhard et al.
7,577,282 B2 8/2009 Gkanatsios et al.
7,583,786 B2 9/2009 Jing et al.
7,609,806 B2 10/2009 Defreitas et al.
7,609,808 B2 10/2009 Tornai
7,616,731 B2 11/2009 Pack
7,616,801 B2 11/2009 Gkanatsios et al.
7,630,531 B2 12/2009 Chui
7,630,533 B2 12/2009 Ruth et al.
7,688,940 B2 3/2010 Defreitas et al.
7,697,660 B2 4/2010 Ning
7,702,142 B2 4/2010 Ren et al.
7,760,853 B2 7/2010 Jing et al.
7,760,924 B2 7/2010 Ruth et al.
7,792,241 B2 * 9/2010 Wu ..... H01J 35/045 378/114
7,792,245 B2 9/2010 Hitzke et al.
7,831,296 B2 11/2010 Defreitas et al.
7,839,979 B2 11/2010 Hauttmann
7,869,563 B2 1/2011 Defreitas et al.
7,869,862 B2 1/2011 Seppi
7,881,428 B2 2/2011 Jing et al.
7,885,384 B2 2/2011 Mannar
7,894,646 B2 2/2011 Shirahata et al.
7,916,915 B2 3/2011 Gkanatsios et al.
7,949,091 B2 5/2011 Jing et al.
7,986,765 B2 7/2011 Defreitas et al.
7,991,106 B2 8/2011 Ren
8,031,834 B2 10/2011 Ludwig
8,131,049 B2 3/2012 Ruth et al.
8,155,421 B2 4/2012 Ren et al.
8,170,320 B2 5/2012 Smith et al.
8,175,219 B2 5/2012 Defreitas et al.
8,285,020 B2 10/2012 Gkanatsios et al.
8,416,915 B2 4/2013 Jing et al.
8,452,379 B2 5/2013 DeFreitas et al.
8,457,282 B2 6/2013 Baorui et al.
8,515,005 B2 8/2013 Ren et al.
8,532,745 B2 9/2013 DeFreitas et al.
8,559,595 B2 10/2013 Defreitas et al.
8,565,372 B2 10/2013 Stein et al.
8,565,374 B2 10/2013 DeFreitas et al.
8,565,860 B2 10/2013 Kimchy
8,571,289 B2 10/2013 Ruth et al.
8,712,127 B2 4/2014 Ren et al.
8,767,911 B2 7/2014 Ren et al.
8,787,522 B2 7/2014 Smith et al.
8,831,171 B2 9/2014 Jing et al.
8,853,635 B2 10/2014 O'Connor
8,873,716 B2 10/2014 Ren et al.
9,042,612 B2 5/2015 Gkanatsios et al.
9,066,706 B2 6/2015 Defreitas et al.
9,226,721 B2 1/2016 Ren et al.
9,460,508 B2 10/2016 Gkanatsios et al.
9,498,175 B2 11/2016 Stein et al.
9,502,148 B2 11/2016 Ren
9,549,709 B2 1/2017 DeFreitas et al.
9,851,888 B2 12/2017 Gkanatsios et al.
9,895,115 B2 2/2018 Ren
10,108,329 B2 10/2018 Gkanatsios et al.
10,194,875 B2 2/2019 DeFreitas et al.
10,296,199 B2 5/2019 Gkanatsios
10,413,255 B2 9/2019 Stein
10,452,252 B2 10/2019 Gkanatsios et al.
10,638,994 B2 5/2020 DeFreitas
10,719,223 B2 7/2020 Gkanatsios
10,881,359 B2 1/2021 Williams
2001/0038681 A1 11/2001 Stanton et al.
2002/0012450 A1 1/2002 Tsujii
2002/0048343 A1 4/2002 Launay et al.
2002/0050986 A1 5/2002 Inoue et al.
2002/0070970 A1 6/2002 Wood et al.
2002/0075997 A1 6/2002 Unger et al.
2002/0090055 A1 7/2002 Zur et al.
2002/0094062 A1 7/2002 Dolazza
2002/0113681 A1 8/2002 Byram
2002/0122533 A1 9/2002 Marie et al.
2002/0126798 A1 9/2002 Harris
2003/0007598 A1 1/2003 Wang et al.
2003/0010923 A1 1/2003 Zur
2003/0018272 A1 1/2003 Treado et al.
2003/0026386 A1 2/2003 Tang et al.
2003/0058989 A1 3/2003 Rotondo
2003/0072409 A1 4/2003 Kaufhold et al.
2003/0072417 A1 4/2003 Kaufhold et al.
2003/0073895 A1 4/2003 Nields et al.

(56) References Cited

U.S. PATENT DOCUMENTS

2003/0095624 A1 5/2003 Eberhard et al.
2003/0097055 A1 5/2003 Yanof et al.
2003/0149364 A1 8/2003 Kapur
2003/0169847 A1 9/2003 Karellas et al.
2003/0194050 A1 10/2003 Eberhard
2003/0194051 A1 10/2003 Wang et al.
2003/0194121 A1 10/2003 Eberhard et al.
2003/0210254 A1 11/2003 Doan et al.
2003/0212327 A1 11/2003 Wang et al.
2003/0215120 A1 11/2003 Uppaluri et al.
2004/0008809 A1 1/2004 Webber
2004/0066882 A1 4/2004 Eberhard et al.
2004/0066884 A1 4/2004 Hermann Claus et al.
2004/0066904 A1 4/2004 Eberhard et al.
2004/0070582 A1 4/2004 Smith et al.
2004/0094167 A1 5/2004 Brady et al.
2004/0101095 A1 5/2004 Jing et al.
2004/0109529 A1 6/2004 Eberhard et al.
2004/0146221 A1 7/2004 Siegel et al.
2004/0171986 A1 9/2004 Tremaglio, Jr. et al.
2004/0190682 A1 9/2004 Deuringer
2004/0213378 A1 10/2004 Zhou et al.
2004/0247081 A1 12/2004 Halsmer
2004/0264627 A1 12/2004 Besson
2004/0267157 A1 12/2004 Miller et al.
2005/0025278 A1 2/2005 Hagiwara
2005/0049497 A1 3/2005 Krishnan
2005/0049521 A1 3/2005 Miller et al.
2005/0063509 A1 3/2005 DeFreitas et al.
2005/0078797 A1 4/2005 Danielsson et al.
2005/0089205 A1 4/2005 Kapur
2005/0105679 A1 5/2005 Wu et al.
2005/0113681 A1 5/2005 DeFreitas et al.
2005/0113715 A1 5/2005 Schwindt et al.
2005/0117694 A1 6/2005 Francke
2005/0129172 A1 6/2005 Mertelmeier
2005/0133706 A1 6/2005 Eberhard
2005/0135555 A1 6/2005 Claus et al.
2005/0135664 A1 6/2005 Kaufhold et al.
2005/0226375 A1 10/2005 Eberhard et al.
2005/0248347 A1 11/2005 Damadian
2006/0009693 A1 1/2006 Hanover et al.
2006/0030784 A1 2/2006 Miller et al.
2006/0034426 A1 2/2006 Freudenberger
2006/0074288 A1 4/2006 Kelly
2006/0098855 A1 5/2006 Gkanatsios et al.
2006/0109951 A1 5/2006 Popescu
2006/0126780 A1 6/2006 Rotondo
2006/0129062 A1 6/2006 Nicoson et al.
2006/0155209 A1 7/2006 Miller et al.
2006/0210016 A1 9/2006 Francke
2006/0257009 A1 11/2006 Wang
2006/0262898 A1 11/2006 Partain
2006/0269041 A1 11/2006 Mertelmeier
2006/0291618 A1 12/2006 Eberhard et al.
2007/0030949 A1 2/2007 Jing et al.
2007/0036265 A1 2/2007 Jing et al.
2007/0076844 A1 4/2007 Defreitas et al.
2007/0078335 A1 4/2007 Horn
2007/0140419 A1 6/2007 Souchay
2007/0223651 A1 9/2007 Wagenaar et al.
2007/0225600 A1 9/2007 Weibrecht et al.
2007/0242800 A1 10/2007 Jing et al.
2008/0019581 A1 1/2008 Gkanatsios et al.
2008/0045833 A1 2/2008 Defreitas et al.
2008/0056436 A1 3/2008 Pack
2008/0101537 A1 5/2008 Sendai
2008/0112534 A1 5/2008 Defreitas
2008/0118023 A1 5/2008 Besson
2008/0130979 A1 6/2008 Ren
2008/0198966 A1 8/2008 Hjam
2008/0212861 A1 9/2008 Durgan et al.
2008/0285712 A1 11/2008 Kopans
2008/0317196 A1 12/2008 Imai
2009/0003519 A1 1/2009 Defreitas et al.
2009/0010384 A1 1/2009 Jing et al.
2009/0080594 A1 3/2009 Brooks et al.
2009/0080602 A1 3/2009 Brooks et al.
2009/0080604 A1 3/2009 Shores et al.
2009/0135997 A1 5/2009 Defreitas et al.
2009/0141859 A1 6/2009 Gkanatsios et al.
2009/0143674 A1 6/2009 Nields
2009/0177495 A1 7/2009 Abousy
2009/0213987 A1 8/2009 Stein et al.
2009/0237924 A1 9/2009 Ladewig
2009/0238424 A1 9/2009 Arakita et al.
2009/0268865 A1 10/2009 Ren et al.
2009/0296882 A1 12/2009 Gkanatsios
2009/0304147 A1 12/2009 Jing et al.
2010/0020937 A1 1/2010 Hautmann
2010/0020938 A1 1/2010 Koch
2010/0034450 A1 2/2010 Mertelmeier
2010/0054400 A1 3/2010 Ren
2010/0086188 A1 4/2010 Ruth
2010/0091940 A1 4/2010 Ludwig et al.
2010/0150306 A1 6/2010 Defreitas et al.
2010/0189227 A1 7/2010 Mannar
2010/0195882 A1 8/2010 Ren
2010/0226475 A1 9/2010 Smith
2010/0290585 A1 11/2010 Eliasson
2010/0303202 A1 12/2010 Ren
2010/0313196 A1 12/2010 De Atley
2011/0026667 A1 2/2011 Poorter
2011/0069809 A1 3/2011 Defreitas et al.
2011/0087132 A1 4/2011 DeFreitas et al.
2011/0178389 A1 7/2011 Kumar et al.
2011/0188624 A1 8/2011 Ren
2011/0234630 A1 9/2011 Batman et al.
2011/0237927 A1 9/2011 Brooks et al.
2011/0268246 A1 11/2011 Dafni
2012/0033868 A1 2/2012 Ren
2012/0051502 A1 3/2012 Ohta et al.
2012/0236987 A1 9/2012 Ruimi
2012/0238870 A1 9/2012 Smith et al.
2013/0028374 A1 1/2013 Gkanatsios et al.
2013/0077748 A1 3/2013 Althoff
2013/0211261 A1 8/2013 Wang
2013/0272494 A1 10/2013 DeFreitas et al.
2014/0044230 A1 2/2014 Stein et al.
2014/0044231 A1 2/2014 Defreitas et al.
2014/0086471 A1 3/2014 Ruth et al.
2014/0098935 A1 4/2014 Defreitas et al.
2014/0232752 A1 8/2014 Ren et al.
2014/0314198 A1 10/2014 Ren et al.
2014/0321607 A1 10/2014 Smith
2014/0376690 A1 12/2014 Jing et al.
2015/0049859 A1 2/2015 DeFreitas et al.
2015/0117617 A1* 4/2015 Ishihara ..... H01J 3/06 378/138
2015/0160848 A1 6/2015 Gkanatsios et al.
2015/0310611 A1 10/2015 Gkanatsios et al.
2015/0347693 A1 12/2015 Lam
2016/0106383 A1 4/2016 Ren et al.
2016/0220207 A1 8/2016 Jouhikainen
2016/0256125 A1 9/2016 Smith
2016/0270742 A9 9/2016 Stein et al.
2016/0331339 A1 11/2016 Guo
2017/0024113 A1 1/2017 Gkanatsios et al.
2017/0128028 A1 5/2017 DeFreitas et al.
2017/0135650 A1 5/2017 Stein et al.
2017/0135653 A1 5/2017 Ren
2017/0319167 A1 11/2017 Goto
2017/0372863 A1* 12/2017 Price ..... H01J 1/15
2018/0005796 A1* 1/2018 Iida ..... H05G 1/32
2018/0068066 A1 3/2018 Bronkalla
2018/0130201 A1 5/2018 Bernard
2018/0177476 A1 6/2018 Jing et al.
2018/0188937 A1 7/2018 Gkanatsios et al.
2018/0289347 A1 10/2018 DeFreitas et al.
2018/0344276 A1 12/2018 DeFreitas et al.
2019/0059830 A1 2/2019 Williams
2019/0095087 A1 3/2019 Gkanatsios et al.
2019/0138693 A1 5/2019 Meller
2019/0188848 A1 6/2019 Madani

(56) References Cited

U.S. PATENT DOCUMENTS

| | | | | |
|---|---|---|---|---|
| 2019/0200942 | A1 | 7/2019 | DeFreitas | |
| 2019/0221304 | A1 | 7/2019 | Ionasec | |
| 2019/0295248 | A1 | 9/2019 | Nakamura | |
| 2019/0304736 | A1* | 10/2019 | Matsuura | H01J 35/16 |
| 2019/0336794 | A1 | 11/2019 | Li | |
| 2020/0012417 | A1 | 1/2020 | Gkanatsios | |
| 2020/0029927 | A1 | 1/2020 | Wilson | |
| 2020/0085393 | A1 | 3/2020 | Zhang | |
| 2020/0167920 | A1 | 5/2020 | Hall | |
| 2020/0286613 | A1 | 9/2020 | Rego | |
| 2020/0348835 | A1 | 11/2020 | Gkanatsios | |
| 2020/0352531 | A1 | 11/2020 | Smith | |
| 2021/0298700 | A1 | 9/2021 | Williams | |
| 2021/0303078 | A1 | 9/2021 | Wells | |

FOREIGN PATENT DOCUMENTS

| | | | |
|---|---|---|---|
| DE | 102004051401 | | 5/2006 |
| DE | 102004051820 | | 5/2006 |
| DE | 102010027871 | | 10/2011 |
| DE | 102011007215 | A1 | 10/2012 |
| EP | 0775467 | | 5/1997 |
| EP | 0982001 | | 3/2000 |
| EP | 1028451 | | 8/2000 |
| EP | 1428473 | | 6/2004 |
| EP | 1623672 | | 2/2006 |
| EP | 1759637 | | 3/2007 |
| EP | 1569556 | | 4/2012 |
| EP | 2732764 | | 5/2014 |
| EP | 2602743 | | 11/2014 |
| EP | 2819145 | | 12/2014 |
| EP | 3143935 | | 3/2017 |
| GB | 415709 | A | 8/1934 |
| JP | 53151381 | U | 11/1978 |
| JP | H 05-329143 | | 12/1993 |
| JP | H07-230778 | A | 8/1995 |
| JP | 2000-287960 | | 10/2000 |
| JP | 2001-346786 | | 12/2001 |
| JP | 2002219124 | | 8/2002 |
| JP | 2004-511884 | | 4/2004 |
| JP | 2004-188200 | | 7/2004 |
| JP | 2004-528682 | | 9/2004 |
| JP | 2005-142160 | | 6/2005 |
| JP | 2006-519625 | | 8/2006 |
| JP | 2006-231054 | | 9/2006 |
| JP | 2007-50264 | | 3/2007 |
| JP | 2007-054528 | | 3/2007 |
| JP | 2007-521911 | | 8/2007 |
| JP | 2007229269 | | 9/2007 |
| JP | 2008-67933 | | 3/2008 |
| JP | 2008086471 | | 4/2008 |
| JP | 2008-159317 | | 7/2008 |
| JP | 2009500048 | | 1/2009 |
| JP | 2011-516116 | | 5/2011 |
| WO | WO 90/05485 | | 5/1990 |
| WO | WO 9803115 | | 1/1998 |
| WO | WO 98/16903 | | 4/1998 |
| WO | WO 00/51484 | | 9/2000 |
| WO | WO 2000068863 | | 11/2000 |
| WO | WO 03/020114 | | 3/2003 |
| WO | WO 03037046 | | 5/2003 |
| WO | WO 2003/057564 | | 7/2003 |
| WO | WO 2004/043535 | | 5/2004 |
| WO | WO 2005/051197 | | 6/2005 |
| WO | WO 2005/110230 | | 11/2005 |
| WO | WO 2005/112767 | | 12/2005 |
| WO | 2006/004185 | | 1/2006 |
| WO | 2006055830 | | 5/2006 |
| WO | WO 2006/055830 | | 5/2006 |
| WO | WO 2006/058160 | | 6/2006 |
| WO | WO 2007129244 | | 11/2007 |
| WO | WO 2008072144 | | 6/2008 |
| WO | WO 2009122328 | | 10/2009 |
| WO | WO 2009136349 | | 11/2009 |
| WO | WO 2010/070554 | | 6/2010 |
| WO | WO 2013/184213 | | 12/2013 |
| WO | 2019/030410 | | 2/2019 |
| WO | 2016/057960 | | 5/2019 |

OTHER PUBLICATIONS

"Filtered Back Projection," (NYGREN) published May 8, 2007; URL:http://web.archive.org/web/19991010131715/http://www.owlnet.rice.edu/-.about.e1ec539/Projects97/cult/node2.html., 2 pgs.

"Lorad Selenia" Document B-BI-SEO US/Intl (May 2006) copyright Hologic 2006, 12 pgs.

ACRIN website, located at https://www.acrin.org/PATIENTS/ABOUTIMAGINGEXAMSANDAGENTS/ABOUTMAMMOGRAPHYANDTOMOSYNTHESIS.aspx, "About Mammography and Tomosynthesis", obtained online on Dec. 8, 2015, 5 pgs.

American College of Radiology website, located at http://www.acr.org/FAQs/DBT-FAQ, "Digital Breast Tomosynthesis FAQ For Insurers", obtained online on Dec. 8, 2015, 2 pages.

Arfelli, F. et al., "Mammography with synchrotron radiation: phase-detection techniques", Apr. 2000, retrieved at: https://www.ncbi.nlm.nih.gov/pubmed/10751500, 8 pages.

Aslund, Magnus, "Digital Mammography with a Photon Counting Detector in a Scanned Multislit Geometry", Doctoral Thesis, Dept of Physics, Royal Institute of Technology, Stockholm, Sweden, Apr. 2007, 51 pages.

Boone, J. et al., "Dedicated Breast CT: Radiation Dose and Image Quality Evaluation", Dec. 31, 2001, retrieved at: http://pubs.rsna.org/doi/abs/10.1148/radiol.2213010334, 11 pages.

Chan, Heang-Ping et al., "ROC study of the effect of stereoscopic imaging on assessment of breast lesions", Medical Physics, vol. 32, No. 4, Apr. 2005, 7 pgs.

Cole, Elodia, et al., "The Effects of Gray Scale Image Processing on Digital Mammography Interpretation Performance", Academic Radiology, vol. 12, No. 5, pp. 585-595, May 2005.

Digital Clinical Reports, Tomosynthesis, GE Brochure 98-5493, Nov. 1998, 8 pgs.

Dobbins, James T., "Digital x-ray tomosynthesis: current state of the art and clinical potential," Physics in Medicine and Biology, Taylor and Francis LTD, London GB, vol. 48, No. 19, Oct. 7, 2003, 42 pages.

Grant, David G., "Tomosynthesis: a three-dimensional imaging technique", IEEE Trans. Biomed. Engineering, vol. BME-19, #1, Jan. 1972, pp. 20-28.

Hamberg, Leena M., "Tomosynthesis breast imaging: early detection and characterization of breast cancer", prepared by Massachusetts General Hospital for the U.S. Army Medical Research and Material Command Fort Detrick, Maryland, Jul. 2000, 20 pages.

Kachelriess, Marc et al., "Flying Focal Spot (FFS) in Cone-Beam CT", 2004 IEEE Nuclear Science Symposium Conference Record, Oct. 16-22, 2004, Rome Italy, vol. 6, pp. 3759-3763.

Kapur, Ajay et al., "Combination of Digital Mammography with Semiautomated 3D Breast Ultrasound", Aug. 1, 2004, retrieved at: http://journals.sagepub.com/doi/abs/10.1177/153303460400300402, 10 pages.

Kita et al., "Correspondence between different view breast X-rays using simulation of breast deformation", Proceedings 1998 IEE Computer Society Conference on Computer Vision and Pattern Recognition, Santa Barbara, CA, Jun. 23-25, 1998, pp. 700-707.

Kopans, D., "Development and Clinical Evaluation of Tomosynthesis for Digital Mammography", Oct. 31, 2000, retrieved at: http://oai.dtic.mil/oai/oai?verb=getRecord&metadataPrefix=html&identifier=ADA387722, 91 pages.

Kopans, Daniel B., "Breast Imaging", Chapter 26: Future Advances in Breast Imaging, 2nd Edition, Lippincott-Raven Publishers, Philadelphia, 1998, 37 pages.

Lehmann, V. et al., "MEMS techniques applied to the fabrication of anti-scatter grids for X-ray imaging", 2002, retrieved at: https://www.researchgate.net/profile/S_Ronnebeck/publication/222546207_MEMS_techniques_applied_to_the_fabrication_of_anti-scatter_grids_for_Xray_imaging/links/5570136f08aeccd777417301/MEMS-techniques-applied-to-the-fabrication-of-anti-scatter-grids-for-X-ray-imaging.pdf, 6 pages.

(56) References Cited

OTHER PUBLICATIONS

Mammographic Accreditation Phantom, http://www.cirsinc.com/pdfs/015cp.pdf. (2006), 2 pgs.
Niklason et al., "Digital Breast Imaging: Tomosynthesis and Digital Subtraction Mammography", Breast Disease, vol. 10, No. 3-4, pp. 151-164, 1998.
Niklason, Loren T. et al., "Digital Tomosynthesis in Breast Imaging", Radiology, Nov. 1997, vol. 205, No. 2, pp. 399-406.
Nykanen, Kirsi et al., "X-ray scattering in full-field digital mammography", Jul. 2003, retrieved at: http://www.siltanen-research.net/publ/NykanenSiltanen2003.pdf, 10 pages.
Pediconi, Federica et al., "Color-coded automated signal intensity-curve for detection and characterization of breast lesions: Preliminary evaluation of a new software for MR-based breast imaging", International Congress Series 1281 (2005) 1081-1086.
Pisano, Etta D., "Digital Mammography", Radiology, vol. 234, No. 2, Feb. 2005, pp. 353-362.
Senographe 700 & 800T (GE); 2-page download on Jun. 22, 2006 from www.gehealthcare.com/inen/rad/whe/products/mswh800t.html.; Figures 1-7 on 4 sheets re lateral shift compression paddle, 2 pgs.
Smith, A., "Fundamentals of Breast Tomosynthesis", White Paper, Hologic Inc., WP-00007, Jun. 2008, 8 pgs.
Smith, Andrew, PhD, "Full Field Breast Tomosynthesis", Hologic White Paper, Oct. 2004, 6 pgs.
Suryanarayanan, S. et al., "Comparison of tomosynthesis methods used with digital mammography", Dec. 31, 2000, retrieved at: http://www.sciencedirect.com/science/article/pii/S1076633200800616, 13 pages.
Suryanarayanan, S. et al., "Evaluation of Linear and Nonlinear Tomosynthetic Reconstruction Methods in Digital Mammography", Mar. 2001, retrieved at: http://www.sciencedirect.com/science/article/pii/S1076633203805305, 6 pages.
Webber, Richard, "A controlled evaluation of tuned-aperture computed tomography applied to digital spot mammography", Feb. 2000, retrieved at: https://www.ncbi.nlm.nih.gov/pmc/articles/PMC3453191/, 8 pages.
Wheeler F. W., et al. "Micro-Calcification Detection in Digital Tomosynthesis Mammography", Proceedings of SPIE, Conf-Physics of Semiconductor Devices, Dec. 11, 2001 to Dec. 15, 2001, Delhi, SPIE, US, vol. 6144, Feb. 13, 2006, 12 pgs.
Wu, T. et al., "A comparison of reconstruction algorithms for breast tomosynthesis", Aug. 26, 2004, retrieved at: http://onlinelibrary.wiley.com/doi/10.1118/1.1786692/full.
Wu, Tao, et al. "Tomographic Mammography Using a Limited Number of Low-Dose Cone-Beam Projection Images" Medical Physics, AIP, Melville, NY, vol. 30, No. 3, Mar. 1, 2003, p. 365-380.
Niklason et al., "Digital breast tomosynthesis: potentially a new method for breast cancer screening", In Digital Mammography, 1998, 6 pages.
Thurfjell, "Mammography screening: one versus two views and independent double reading", Acta Radiologica 35, No. 4, 1994, pp. 345-350.
European Communication and Search Report in Application EP 20211718.0, dated Apr. 21, 2021, 13 pages.
Rolf Behling—Ed-Behling et al., Chapter 6: Diagnostic X-Ray Sources from the Inside, Modern Diagnostic X-Ray Sources, Taylor & Francis Group, pp. 177-308, Jan. 1, 2016, retrieved from the internet on Jun. 26, 2015 at: https://ebookcentral.proquest.com/lib/epo-ebooks/detail.action?docID=2075866.
Choi, Bareum et al., "Surgical-tools detection based on Convolutional Neural Network in Laparoscopic Robot-Assisted Surrgery", 2017 39th Annual Int'l. Conference of the IEEE Engineering in Medicine and Biology Society (EMBC), IEEE, Jul. 11, 2017, pp. 1756-1759.
Han et al., "MatchNet: Unifying Feature and Metric Learning for Patch-Based Matching", 2015 IEEE Conference on Computer Vision and Pattern Recognition (CVPR), Boston, MA, 2015, pp. 3279-3286.

* cited by examiner

SYSTEMS AND METHODS FOR IMPROVED X-RAY TUBE LIFE

CROSS-REFERENCE TO RELATED APPLICATIONS

This application claims the benefit of U.S. Provisional Application No. 62/944,126, titled, "SYSTEMS AND METHODS FOR IMPROVED X-RAY TUBE LIFE," filed Dec. 5, 2019, which application is incorporated herein by its reference in its entirety.

BACKGROUND

Imaging based on the use of x-rays is commonplace in medical imaging technology, such as mammography or tomosynthesis systems. The x-rays used in such imaging technology are often generated through the use of an x-ray tube. The x-ray tube, however, has a limited lifetime. When the x-ray tube reaches the end of its lifetime, the tube must be replaced. The replacement process can be expensive, time consuming, and delay medical imaging procedures for patients.

SUMMARY

The present technology relates to systems and methods for increasing the lifetime of an x-ray tube. In an aspect, the technology relates to an x-ray tube that includes a focusing cup and an anode. The x-ray tube further includes a first filament positioned in a first location between the focusing cup and the anode, the first filament having a first size; a second filament positioned in a second location between the focusing cup and anode, the second filament having a second size that is substantially the same as the first size; and a switching mechanism configured to engage the second filament upon failure of the first filament. In an example, the x-ray tube further includes a first electrode and a second electrode positioned between the second filament and the anode, and the first electrode is positioned opposite an electron beam path from the second electrode. In another example, the first electrode and the second electrode are configured to, when a first control signal is applied across the first and second electrode, generate an electric field that moves an electron beam in a first direction. In yet another example, the first filament is configured to generate a first electron beam having a first focal spot on the anode; the second filament is configured to generate a second electron beam; and the control signal is configured to move the second electron beam such that the second electron beam has a second focal spot on the anode that is substantially the same as the first focal spot.

In a further example, the x-ray tube further includes a third electrode and a fourth electrode, wherein the third electrode and the fourth electrode are configured to, when a second control signal is applied across the third and the fourth electrode, generate an electric field that moves the electron beam in a second direction. In still another example, the switching mechanism is a mechanical switch. In still yet another example, the switching mechanism includes at least one transistor or relay configured to automatically engage the second filament upon the failure of the first filament.

In another aspect, the technology relates to an x-ray tube that includes a first focusing cup, a second focusing cup, and an anode. The x-ray tube further includes a first filament located between the first focusing cup and the anode; a second filament positioned between the second focusing cup and the anode; and a switching mechanism configured to engage the second filament upon failure of the first filament. In an example, the x-ray tube further includes a first electrode and a second electrode positioned between the second filament and the anode, wherein the first electrode is positioned opposite an electron beam path from the second electrode. In another example, the first electrode and the second electrode are configured to, when a first control signal is applied across the first and second electrode, generate an electric field that moves an electron beam in a first direction. In yet another example, the first filament is configured to generate a first electron beam having a first focal spot on the anode; the second filament is configured to generate a second electron beam; and the control signal is configured to move the second electron beam such that the second electron beam has a second focal spot on the anode that is substantially the same as the first focal spot.

In a further example, the first filament is configured to generate a first electron beam having a first focal spot on the anode; the second filament is configured to generate a second electron beam; and the first focusing cup and the second focusing cup are positioned such that the second electron beam has a second focal spot on the anode that is substantially the same as the first focal spot. In still another example, the switching mechanism is a mechanical switch.

In another aspect, the x-ray tube includes an anode, a focusing cup, an electron emitting block positioned adjacent to the focusing cup and between the focusing cup and the anode, and a laser configured to emit a laser beam towards the electron emitting block. In an example, the laser is a semiconductor laser bar. In another example, the semiconductor laser bar is housed entirely within the x-ray tube. In yet another example, the electron emitting block is primarily made from tungsten. In still another example. the laser beam has a wavelength of about 272 nm or less. In a further example, the electron emitting block has a thickness of at least 1 mm. In yet another example, the electron emitting block has a surface area facing the laser that is greater than about 8 mm.

In another aspect, the technology relates to a method for producing x-rays from an x-ray tube. The method includes receiving a first activation request for the x-ray tube; activating a first filament in the x-ray tube to generate a first x-ray imaging beam; receiving an indication that the first filament has failed; based on the indication that the first filament has failed, engaging a second filament in the x-ray tube; receiving a second activation request for the x-ray tube; and activating a second filament in the x-ray tube to generate a second x-ray imaging beam that is substantially similar the first x-ray imaging beam. In an example, activating the first filament comprises applying a voltage across the first filament. In another example, activating the second filament comprises applying a voltage across the second filament. In yet another example, engaging the second filament comprises switching a mechanical switch. In still another example, the indication that the first filament has failed is a trigger signal generated based on a high resistance of the first filament. In a further example, the method includes activating a control signal applied across at least one pair of electrodes positioned opposite an electron beam path of the x-ray tube.

In another example, the control signal is activated concurrently with the activation of the second filament. In yet another example, activation of the first filament causes an emission of electrons from the first filament that accelerate towards an anode of the x-ray tube which causes the production of x-rays that form the first x-ray imaging beam.

In still another example, the method includes generating a medical image based on the second x-ray imaging beam.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the description which follows and, in part, will be apparent from the description, or may be learned by practice of the disclosure.

DETAILED DESCRIPTION

Figure 1A:
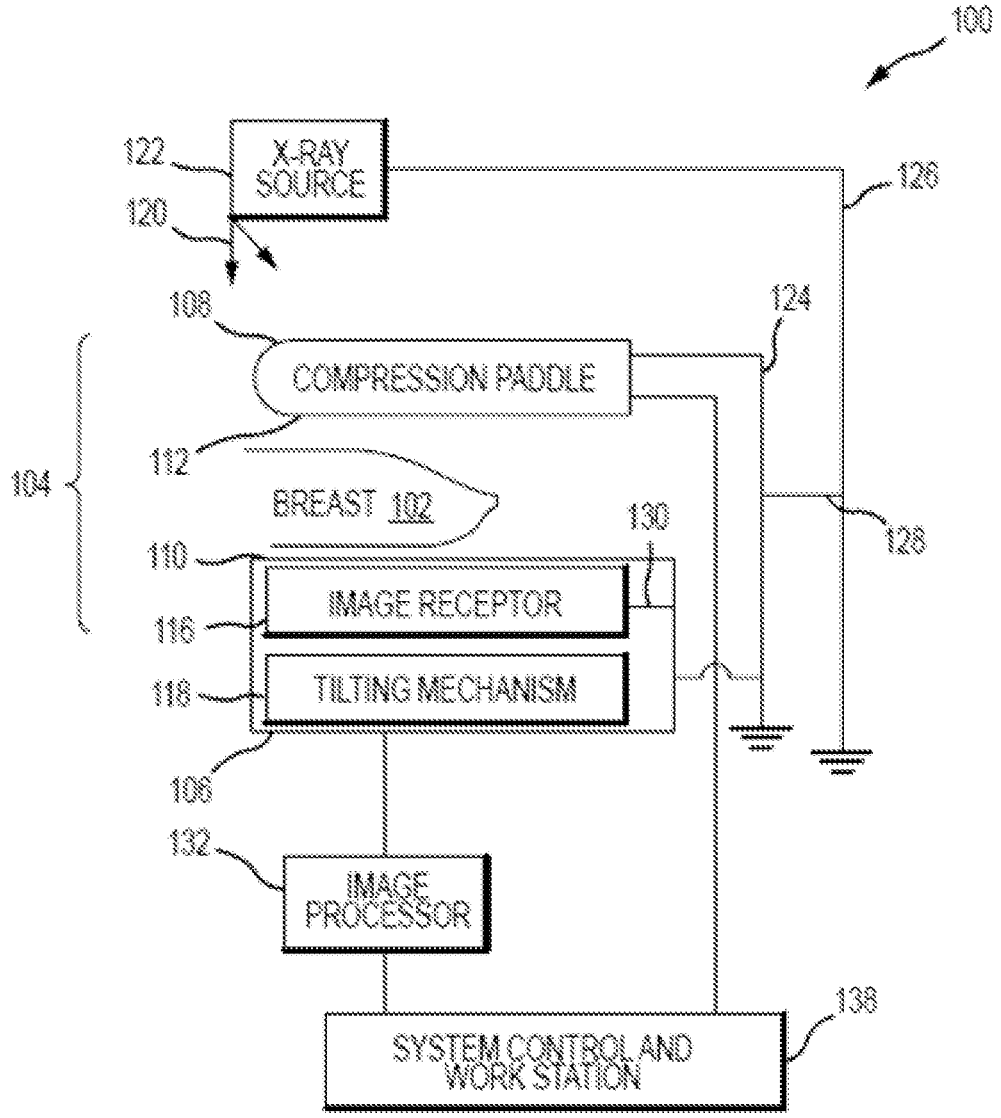
FIG. 1A is a schematic of an example imaging system.

As discussed above, x-ray tubes in medical imaging systems have limited lifetimes. The limited lifetime of x-ray tubes is often due to the high heat and high voltages that are generally required for the operation of an x-ray tube. The high heat and voltages cause the components of the x-ray tube to break down and eventually fail. When the x-ray tube fails, it must be replaced. Replacement of an x-ray tube is a high cost for multiple reasons. First, the cost of the tube itself is often significant. In addition, when an x-ray tube is replaced, the x-ray tube generally must be realigned and the medical imaging system needs to be recalibrated. In some cases, the reinstallation process may cause an examination room or medical imaging system to be unavailable for several days, leading to delayed examinations and imaging of patients. Accordingly, improving the lifetime of an x-ray tube is desired.

Based on analysis of past x-ray tube failures, the primary reason for failure of an x-ray tube is a failed or broken filament. As discussed further below, in some x-ray tubes a filament is used to generate electrons that are accelerated towards an anode of the x-ray tube. During operation of the x-ray tube, the filament may be heated to temperatures greater than 2000 degrees Celsius for thermionic electron emission to occur. The high heat degrades the filament and may cause the filament material to evaporate gradually. The degradation of the filament ultimately causes the filament to break. The size of the filament has been traditionally limited by a desired focal spot size on the anode. Accordingly, simply increasing the size of the filament to increase the lifetime of the x-ray tube is often not an option.

The present technology increases the lifetime of an x-ray tube through the use of multiple filaments or through the use of a laser for heating a cathode of an x-ray tube. For example, an x-ray tube may be provided with two filaments for generating electrons. When the first filament fails, the second or back-up filament may be engaged. Engaging the second filament may be controlled mechanically, such as through a switch, or electronically through control software/firmware or other electronics. Because the filaments must be located at different positions within the x-ray tube, an additional control signal may be applied when the second filament is engaged to preserve a substantially similar focal spot on the anode as produced by the first filament.

In other examples, the filament of the x-ray tube may be replaced by an electron-emitting block of material configured to emit electrons when heated. The electron-emitting block is heated via a laser, such as a semiconductor laser bar, rather than via an electrical current. The use of the laser allows for the electron-emitting block to be a larger size than the filament, leading to a longer lifetime for the x-ray tube, while still allowing for the area emitting electrons to remain a similar size as a filament by controlling the profile of the laser beam and spot size.

Figure 1B:
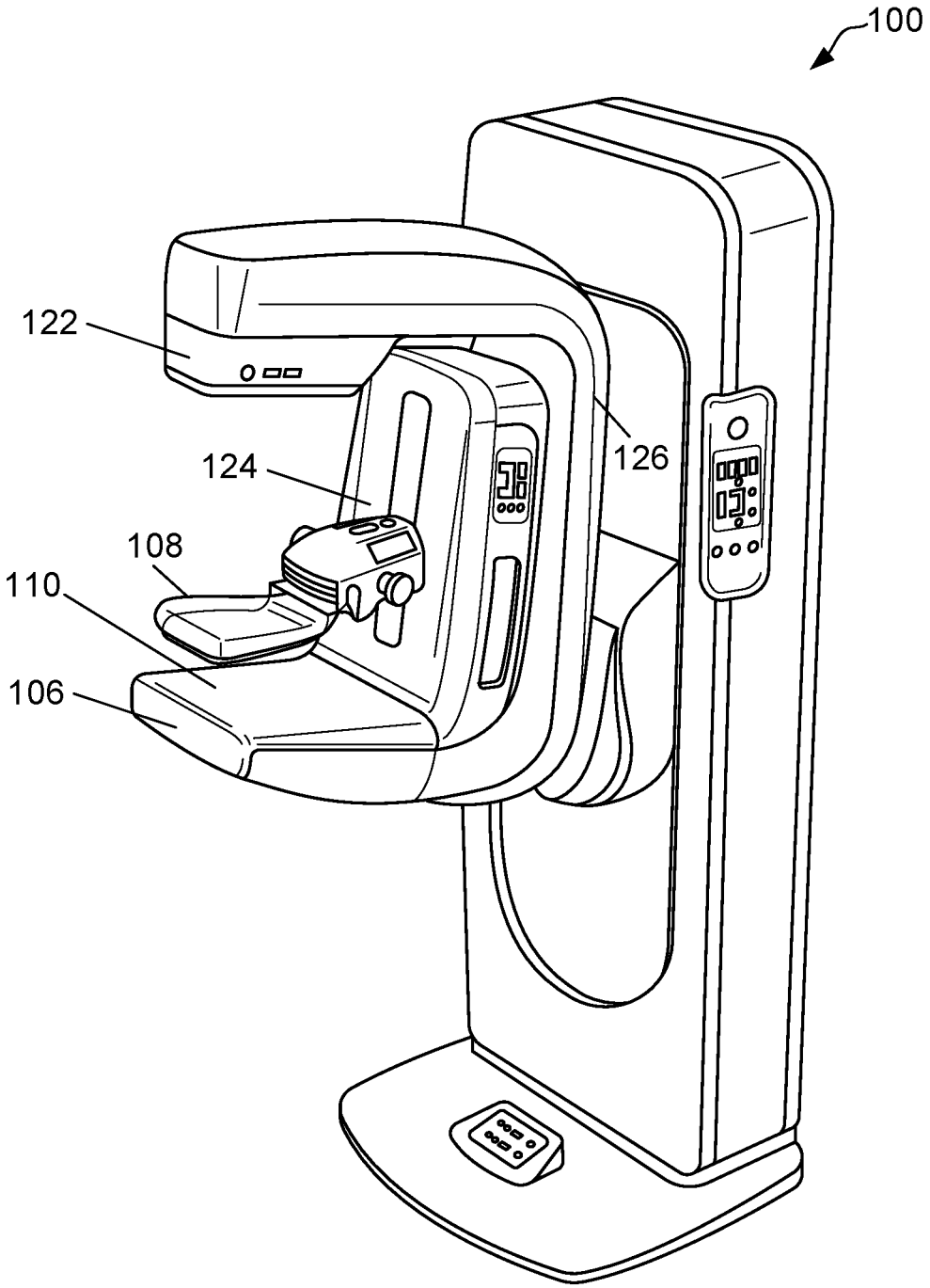
FIG. 1B is a perspective view of the imaging system of FIG. 1A.

FIG. 1A is a schematic view of an exemplary imaging system 100. FIG. 1B is a perspective view of the imaging system 100. Referring concurrently to FIGS. 1A and 1B, the imaging system 100 immobilizes a patient's breast 102 for x-ray imaging (either or both of mammography and tomosynthesis) via a breast compression immobilizer unit 104 that includes a static breast support platform 106 and a moveable compression paddle 108. The breast support platform 106 and the compression paddle 108 each have a compression surface 110 and 112, respectively, that move towards each other to compress and immobilize the breast 102. In known systems, the compression surface 110, 112 is exposed so as to directly contact the breast 102. The platform 106 also houses an image receptor 116 and, optionally, a tilting mechanism 118, and optionally an anti-scatter grid. The immobilizer unit 104 is in a path of an imaging beam 120 emanating from x-ray source 122, such that the beam 120 impinges on the image receptor 116.

The immobilizer unit 104 is supported on a first support arm 124 and the x-ray source 122 is supported on a second support arm 126. For mammography, support arms 124 and 126 can rotate as a unit about an axis 128 between different imaging orientations such as CC and MLO, so that the system 100 can take a mammogram projection image at each orientation. In operation, the image receptor 116 remains in place relative to the platform 106 while an image is taken. The immobilizer unit 104 releases the breast 102 for movement of arms 124, 126 to a different imaging orientation. For tomosynthesis, the support arm 124 stays in place, with the breast 102 immobilized and remaining in place, while at least the second support arm 126 rotates the x-ray source 122 relative to the immobilizer unit 104 and the compressed breast 102 about the axis 128. The system 100 takes plural tomosynthesis projection images of the breast 102 at respective angles of the beam 120 relative to the breast 102.

Concurrently and optionally, the image receptor 116 may be tilted relative to the breast support platform 106 and in sync with the rotation of the second support arm 126. The tilting can be through the same angle as the rotation of the x-ray source 122, but may also be through a different angle selected such that the beam 120 remains substantially in the same position on the image receptor 116 for each of the plural images. The tilting can be about an axis 130, which can but need not be in the image plane of the image receptor 116. The tilting mechanism 118 that is coupled to the image receptor 116 can drive the image receptor 116 in a tilting motion. For tomosynthesis imaging and/or CT imaging, the breast support platform 106 can be horizontal or can be at an angle to the horizontal, e.g., at an orientation similar to that for conventional MLO imaging in mammography. The system 100 can be solely a mammography system, a CT system, or solely a tomosynthesis system, or a "combo" system that can perform multiple forms of imaging. An example of such a combo system has been offered by the assignee hereof under the trade name Selenia Dimensions.

Whether operating in a mammography or a tomosynthesis mode, the system images the breast by emitting an x-ray beam 120 from the x-ray source. The x-ray beam 120 passes through the breast 102 where it is detected by the image receptor 116. The image receptor 116 may include a plurality of pixels that detect the intensity of the x-ray beam 120 at a plurality of locations after the x-ray beam has passed through the breast 102. The attenuation of the x-ray beam 120 as it passes through the breast 102 changes depending on the structures of the breast 102. Accordingly, images of the breast may be produced from the detected x-ray beam 120. For instance, the image receptor 116 produces imaging information in the form of electric signals, and supplies that imaging information to an image processor 132 for processing and generating x-ray images of the breast 102. A system control and work station unit 138 including software controls the operation of the system and interacts with the operator to receive commands and deliver information including images of the breast 102. The system control and work station unit 138 may also include software for controlling the operation of the x-ray source 122.

Figure 2A:
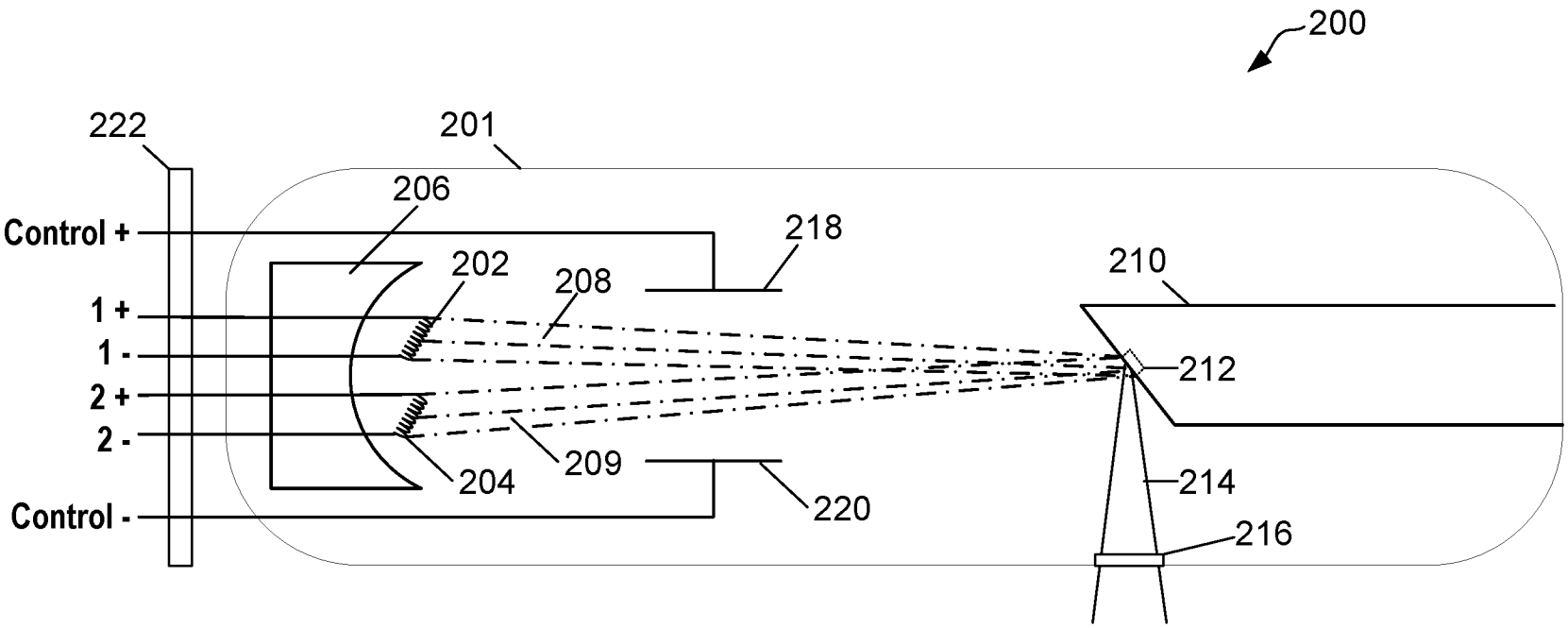
FIG. 2A depicts an example of an x-ray tube having multiple filaments.

FIG. 2A depicts an example of an x-ray tube 200 having multiple filaments 202, 204. The x-ray tube 200 may be included as at least part of the x-ray source 122 discussed above. The x-ray tube 200 includes tube body 201 housing a cathode assembly including a first filament 202, a second filament 204, and a focusing cup 206. The first filament 202 and the second filament 204 may be placed adjacent to the focusing cup 206 and between the focusing cup and an anode 210. The first filament 202 and the second filament 204 may be made from a material with a high melting point, such as tungsten. A voltage or signal may be applied across the first filament 202 via wires connected to each end of the first filament 202, indicated by the 1+ for the positive connection to the first filament 202 and the 1− for the negative connection to the first filament 202. When the signal or voltage is applied across the first filament 202, a current flows through the first filament 202 which heats the first filament 202 and causes electrons to be emitted from the first filament 202. Due a voltage difference between the cathode assembly and the anode 210, the electrons emitted from the first filament 202 are accelerated towards the anode 210. The accelerated electrons form an electron beam 208 that travels along an electron beam path. The electron beam 208 impacts the anode 210, which causes the emission of x-rays 214 from the anode 210. The x-rays 214 exit the x-ray tube body 201 through a tube window 216. The x-rays 214 that exit through the window 216 form the x-ray beam that is used for imaging, such as x-ray beam 120 discussed above with reference to FIGS. 1A-1B.

The area in which the electron beam 208 impacts the anode 210 is referred to as the focal spot 212. The size of the focal spot 212 relates to the resolution desired for the imaging process. For instance, a small focal spot 212 may be used where high resolution of a small area is desired. The location of the focal spot 212 on the anode 210, as well as the angle of the anode 210, also has an effect on the direction of the x-rays 214 produced from the anode 210. The size and location of the focal spot 212 may be controlled or modified by the focusing cup 206. For instance, the focusing cup 206 may include a negative charge that repels the electrons emitted from the first filament 202. That charge, the distribution of that charge, and the shape of the focusing cup 206 may be selected or configured to direct the electrons emitted from the first filament 202 to the focal spot 212 on the anode 210.

When the first filament 202 fails, the second filament 204 may be engaged. Engaging the second filament 204 may be engaged through a switching mechanism 222. The switching mechanism 222 may be located outside of the tube body 201. The switching mechanism 222 may include a mechanical switch that allows for switching between the first filament 202 and the second filament 204. For example, the voltage applied across the first filament 202 may be the same voltage that is applied across the second filament 204. In such examples, a switch may be used to connect the terminals of the second filament 204 to the voltage source rather than the terminals of the first filament 202. In other examples, engaging the second filament 204 may be controlled electronically through control software/firmware or other electronics, such as transistors and/or relays that may be included in the switching mechanism 222. When the first filament 202 fails, current is prevented from flowing across the first filament 202 (or a small amount of current is able to flow due to a high resistance of the failed filament 202). The lack of current flowing when a voltage is applied across the failed first filament 202 may be detected and used as a trigger signal to engage or switch to the second filament 204. The trigger signal may be processed by software or firmware in a medical imaging system, which may then cause the second filament 204 to engage. The trigger signal may also be used to engage the second filament without the use of software or firmware. For instance, the trigger signal may be provided to one or more transistors and/or relays that switch the connection of the voltage source from the terminals of the first filament 202 to the terminals of the second filament 204.

Similar to the operation of the first filament 202, a voltage or signal may be applied across the second filament 204 via wires or terminals connected each end of the second filament 204, indicated by the 2+ for the positive connection to the second filament 204 and the 2− for the negative connection to the second filament 204. When the signal or voltage is applied across the second filament 204, a current flows through the second filament 204 which heats the second filament 204 and causes electrons to be emitted from the second filament 204. Due the voltage difference between the cathode assembly and the anode 210, the electrons emitted from the second filament 204 are accelerated towards the anode 210. The accelerated electrons from the second filament 204 also form an electron beam 209 that impacts the anode 210 and generates x-rays 214.

Due to the difference in location between the first filament 202 and the second filament 204, however, the electron beam 209 generated by the second filament 204 flows in a different direction than, or is offset from, the electron beam 208 generated by the first filament 202. Accordingly, without additional manipulation, the electron beam 209 produced by the second filament 204 produces a different focal spot 212 (in size and/or location) on the anode 210. Having a different focal spot 212 on the anode 210 may be undesirable because the emitted x-ray beam 214 would have different characteristics that may require physical movement of the x-ray tube 200 in the medical imaging system to realign the x-rays 214 with the detector or receptor of the medical imaging system. The present technology helps eliminate the need for physical movement of the x-ray tube 200 by including a set of electrodes 218, 220 on which a control signal may be applied. The control signal may applied across wires or terminals connected to the electrodes 218, 220 as depicted by the Control+ and Control− in FIG. 2A. The first electrode 218 may be positioned opposite the electron beam path from the second electrode 220.

When the control signal is applied across the electrodes 218, 220, an electric field is generated between the electrodes 218, 220. That electric field interacts with the electrons in the electron beam 208 due to the negative charge of the electrons in the electron beam 208. Depending on control signal, the electrons in the electron beam may either be drawn towards the first electrode 218 or the second electrode. By manipulating the control signal applied across the electrodes 218, 220, the location that the electron beam 208 impacting the anode 210 may altered. Thus, the location of the focal spot 212 may be altered. In some examples, the electrodes 218, 220 may be placed either inside or outside the tube body 201. In other examples, the electrodes 218, 220 may be replaced with a single electromagnet that may be controlled via a similar control signal. Activation of the electromagnet causes a magnet field that may be used to also the electron beams 208, 209.

The control signal may be configured to alter the electron beam 209 emitted from the second filament 204 such that the resultant focal spot 212 for the second filament 204 is substantially the same as the focal spot 212 for the electron beam 208 produced from the first filament 202. In some examples where the first filament 202 and the second filament 204 are the same size, the focal spot 212 generated from the first filament 202 and the second filament 204 may inherently be the same size but located in different positions on the anode 210 when no control signal is present. Accordingly, a proper control signal may be used to shift the location of the electron beam 209. The proper control signal may be determined mathematically due to the geometry of the components of the x-ray tube 200 and the relative locations of the first filament 202 and the second filament 204. The proper control signal may also be determined experimentally by detecting a baseline focal spot 212 location for the second filament 204 and iteratively adjusting the control signal until the focal spot 212 for the electron beam 209 from the second filament 204 is substantially the same as the focal spot 212 for the electron beam 208 from the first filament 202. In some examples, the control signal may be a constant direct current (DC) voltage between the two electrodes 218, 220. In other examples, the control signal may be a changing signal causes the formation of an electromagnetic field between the two electrodes 218, 220.

The control signal may be initiated when the second filament 204 is engaged. For example, when the switching mechanism 222 engages the second filament 204, the switching mechanism may also connect the terminals of the electrodes 218, 220 to a control signal source that generates the control signal. For instance, such a connection may be made through a mechanical switch. The connection may also be made through one or more transistors and/or relays. In some examples, the terminals of the electrodes 218, 220 may be more permanent and the control signal source is activated when the second filament 204 is engaged. For instance, the control signal source may be activated by the trigger signal generated when the first filament 202 fails.

In other examples, the control signal and the electrodes 218, 220 may be used to also control or manipulate the electron beam 208 generated from the first filament 202. For instance, the control signal and electrodes 218, 220 may operate to manipulate both the electron beam 209 from the second filament 204 as well as the electron beam 208 from the first filament 202. Both electron beams 208, 209 may be manipulated to form the same focal spot 212.

Figure 2B:
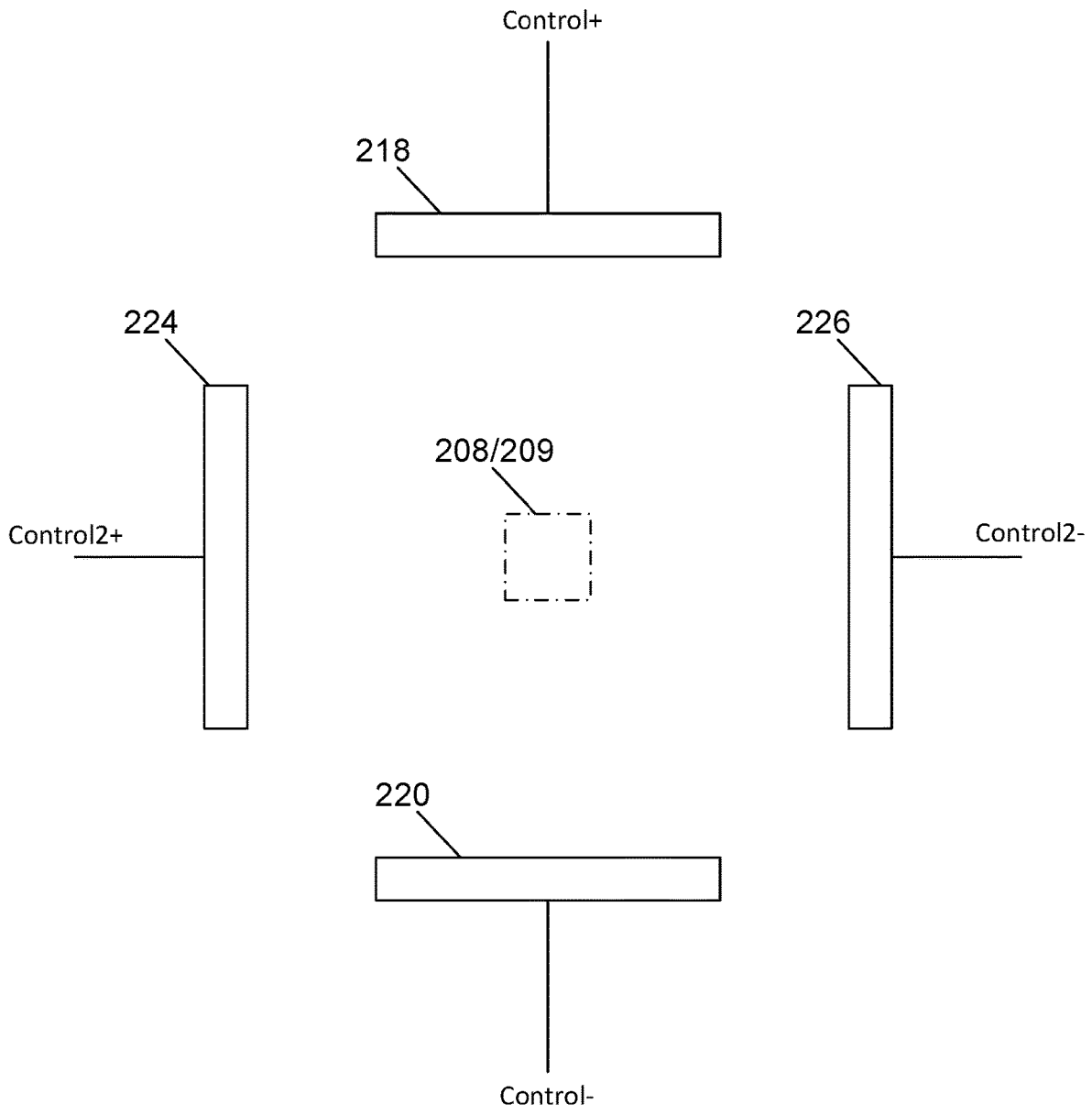
FIG. 2B depicts an example arrangement of electrodes in an example x-ray tube.

FIG. 2B depicts an example arrangement of electrodes 218, 220, 224, 226 in an example x-ray tube, such as x-ray tube 200. While only two electrodes 218, 220 were depicted in FIG. 2A, additional electrodes, such as electrodes 224, 226, may also be included to manipulate or control the electron beam 208 and/or electron beam 209. The view depicted in FIG. 2B is an orthogonal view from the schematic view depicted in FIG. 2A. Accordingly, the electron beam 208 may be viewed as coming out of the page. The additional electrodes 224, 226 allow for additional control of the electron beam 208 such that the electron beam 208 may be moved in a second direction. In the example depicted, the first pair of electrodes 218, 220 may be used to move the electron beam 208 in a first direction (e.g., vertical direction) and the second pair of electrodes 224, 226 may be used to move the electron beam in a second direction (e.g., lateral direction). The second pair of electrodes 224, 226 may also be positioned opposite the electron beam path. The second pair of electrodes 224, 226 may positioned such that they are orthogonal to the first pair of electrodes 218, 220. Additional pairs of electrodes may also be added to move the electron beam 208 in different or additional directions as well.

The second pair of electrodes 224, 226 may be controlled by second control signal. For instance, a terminal of the third electrode 224 and the terminal of the fourth electrode 226 may connected to the control signal source as indicated by the Control2+ and Control2− designations in FIG. 2B. The second control signal may be generated and determined in substantially the same manner as the first control signal used to control the first pair of electrodes 218, 220. The first control signal, however, may be different from the second control signal and have different characteristics.

Figure 3:
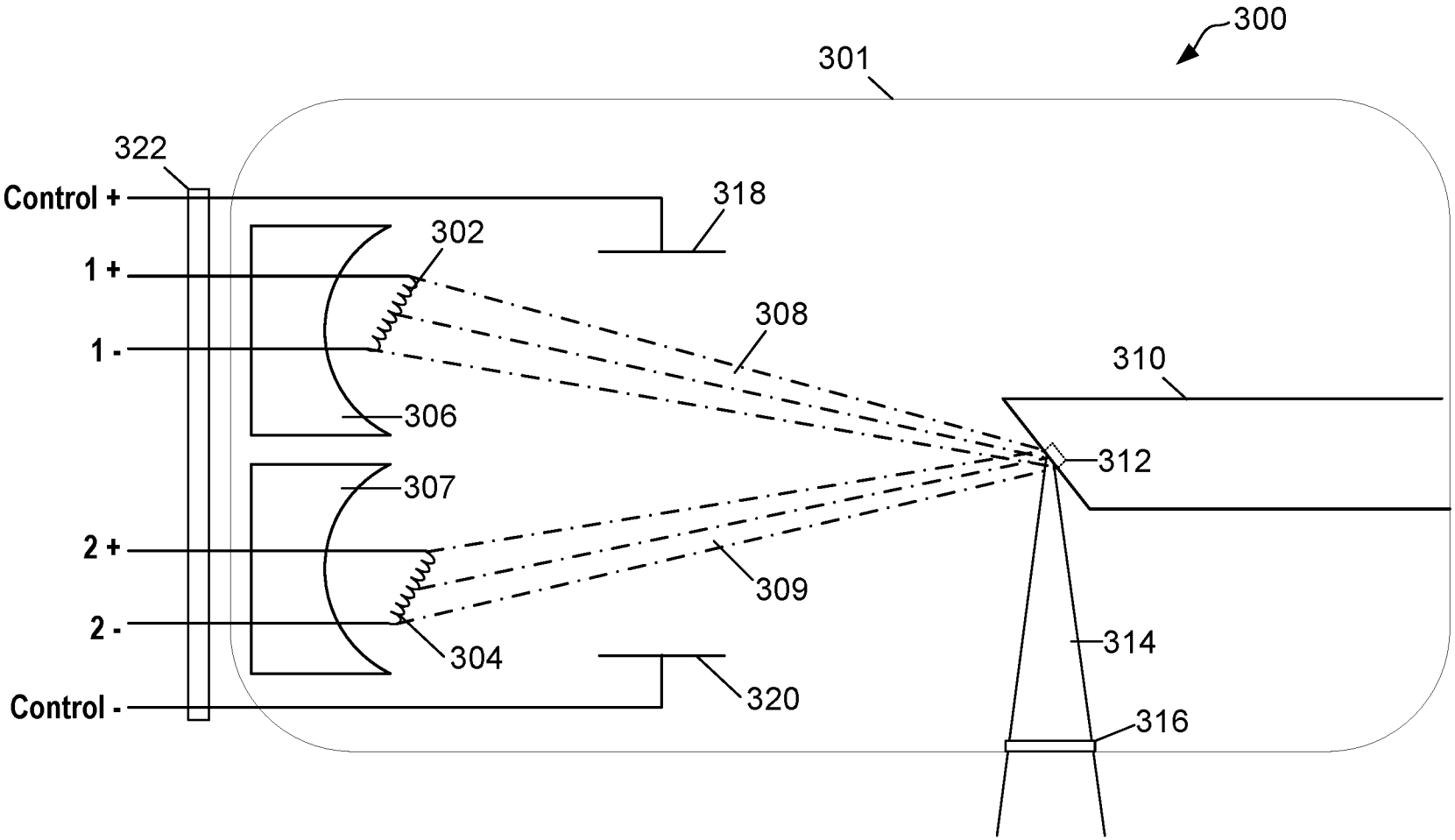
FIG. 3 depicts another example of an x-ray tube having multiple filaments.

FIG. 3 depicts another example of an x-ray tube 300 having multiple filaments 302, 304. The x-ray tube 300 is similar to the x-ray tube 200 discussed above and depicted in FIGS. 2A-2B, with the exception that the x-ray tube 300 includes two focusing cups 306, 307. The first filament 302 is located adjacent to the first focusing cup 306, and the second filament 304 is located adjacent the second focusing cup 307. In some examples, the cathode assembly of the x-ray tube 300 may include the first focusing cup 306, the first filament 302, the second focusing cup 307, and the second filament 304. The first filament 302 and the second filament 304 may be controlled, activated, and/or engaged in the same manner as discussed above, such as through the use of a switching mechanism 322.

When the first filament 302 is activated, such as by causing a current to flow through the first filament 302, a first electron beam 308 is formed that impacts an anode 310. Similarly, when the second filament 304 is activated, such as by causing a current to flow through the second filament 304, a second electron beam 309 is formed that impacts the anode 310. As with the x-ray tube 200 discussed above, it is desirable that in the x-ray tube 300, depicted in FIG. 3, the first electron beam 308 and the second electron beam 309 have substantially the same focal spot 312 of the anode 310. For instance, the focal spot 312 may have the same size and location on the anode 310. By having the same focal spot 312, the first electron beam 308 and the second electron beam 309 cause a similar x-ray beam 314 to be emitted from the anode 310. Thus, the imaging x-ray beam that exits the window 316 of the tube body 301 does not significantly change when the second filament 304 is engaged upon the failure of the first filament 302.

Causing the first electron beam 308 and the second electron beam 309 to have substantially the same focal spot 312 may be achieved through the configuration of the focusing cups 306, 307 and/or the use of a control signal and electrodes 318, 320. For example, the size, shape, position, charge, and/or charge distribution of the first focusing cup 306 may be selected or configured such that the first electron beam 308 forms the focal spot 312 on the anode 310. The size, shape, position, charge, and/or charge distribution of the second focusing cup 307 may also be selected or configured such that the second electron beam 309 forms substantially the same the focal spot 312 on the anode 310. In addition, or alternatively, a control signal applied to a pair of electrodes 318, 320 may also be used to manipulate the first electron beam 308 and/or the second electron beam 309. The pair of electrodes 318, 320 and the control signal may operate in the same or similar manner as the electrodes 218, 220 discussed above with reference to FIGS. 2A-2B. Additional electrodes and control signals may also be utilized and incorporated into the x-ray tube 300, such as the second pair of electrodes 224, 226 discussed above with reference to FIG. 2B.

Figure 4:
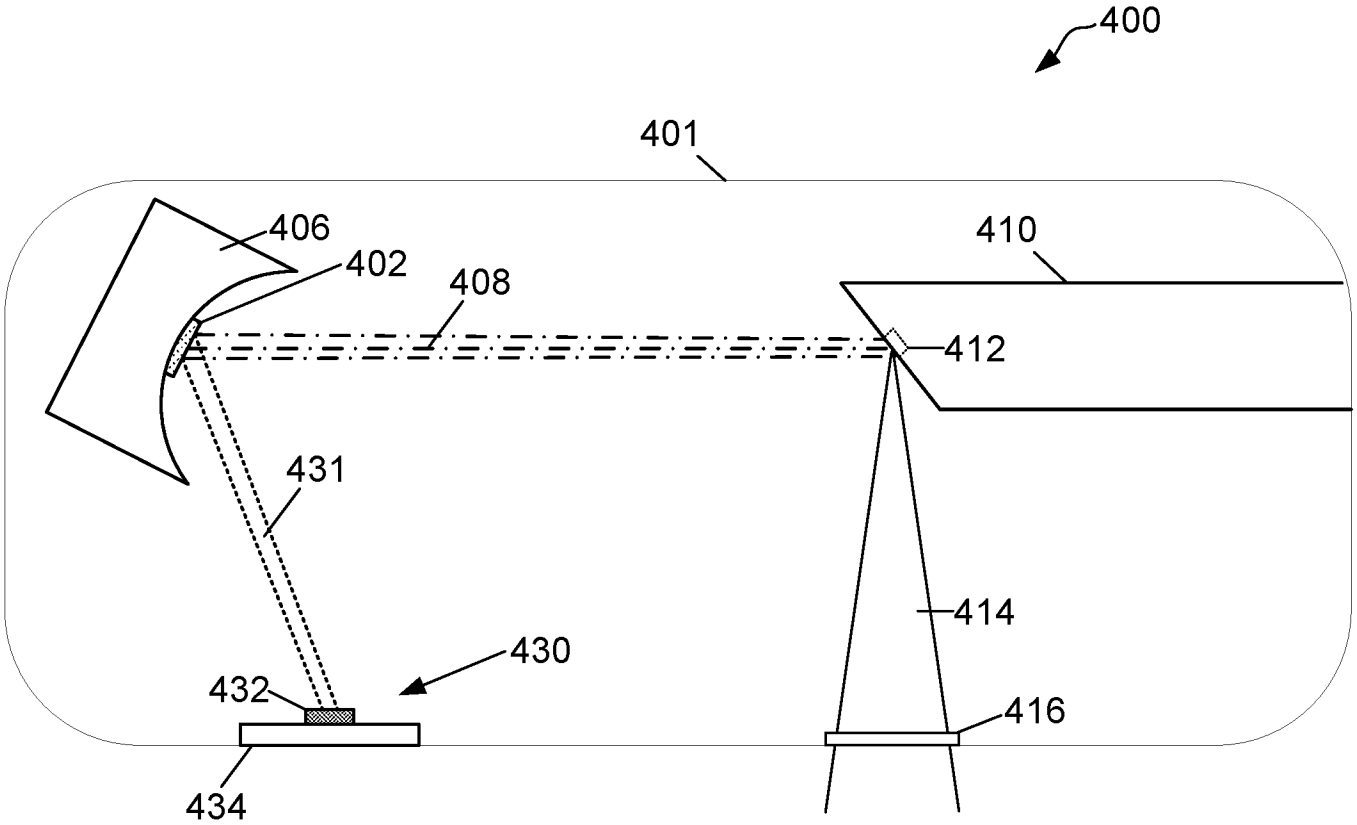
FIG. 4 depicts an example of an x-ray tube having a cathode heated by a laser.

FIG. 4 depicts an example of an x-ray tube 400 having a cathode assembly heated by a laser 430. The x-ray tube 400 includes a tube body 401 housing a cathode assembly including a focusing cup 406 and an electron emitting block 402 positioned adjacent to the focusing cup 406. In some examples, the electron emitting block 402 may be attached to the focusing cup 406. The tube body 401 also houses an anode 410. The electron emitting block 402 is positioned between the focusing cup 406 and the anode 410. The electron emitting block 402 may be a block of material that emits electrons when heated, such as through thermionic emission. In some examples, the electron emitting block 402 may be made from a material with a high melting point. As an example the electron emitting block 402 may be made from primarily from tungsten.

The x-ray tube 400 also includes a laser 430. The laser is configured to emit a laser beam 431 directed at the electron emitting block 402. In some examples, the laser may be a semiconductor laser bar that includes one or more diode lasers 432 attached to a heat sink 434. The diode lasers 432 emit a beam 431 of electromagnetic radiation. The use of a semiconductor laser bar as the type of laser 430 may be beneficial over other types of lasers (e.g., $CO_2$, fiber, etc.) for several reasons. First, semiconductor laser bars can be incorporated in small packages making it easier to incorporate into the x-ray tube 400. The semiconductor laser bar may also be all solid-state device that will not contaminate other elements inside the x-ray tube 400 and may also be able to better withstand the vacuum environment within the x-ray tube 400.

The electromagnetic radiation generated from the laser 430 may have differing frequencies, such as in the infrared spectrum, the visible spectrum, or the ultraviolet spectrum. The laser beam 431 irradiates a portion of the electron emitting block 402. The portion of the electron emitting block 402 that is illuminated is based on the spot size of the laser beam 431. Focusing optics within the laser 430 or positioned between the laser 430 and electron emitting block 402 may be used to change the spot size of the laser beam 431. By changing the spot size of the laser beam, different portions of the electron emitting block 402 may be heated. For instance, the spot size may be configured to substantially match the size and shape of a filament.

Due to the irradiation of the laser beam 431, the temperature of at least the portion of electron emitting block 402 increases. The increase in temperature causes the thermionic emission of electrons similar to the filaments discussed above. In contrast to the filaments, however, the electron emitting block 402 is not heated by electric current flowing through the electron emitting block 402. Thus, the electron emitting block 402 is able to be substantially larger and more robust than a filament, which leads to a longer lifetime of the x-ray tube 400. For example, the electron emitting block 402 may have a thickness of about 1 mm or larger. The surface area of the electron emitting block 402 facing the laser 430 may also be greater than or equal to about 2 mm, 4 mm, 6 mm, 8 mm, 10 mm, 12 mm, 14 mm, 16 mm, 18 mm, or 20 mm. Increasing the size of the electron emitting block 402 may further increase the lifetime of the x-ray tube 400 because the electron emitting block 402 is less likely to degrade and fail over time.

In some examples, depending on the type of material(s) of the electron emitting block 402 and/or the wavelength of the electromagnetic radiation emitted from the laser 430, photoelectric emission of electrons may also occur. As an example, where the electron emitting block 402 includes tungsten, electromagnetic radiation having a wavelength of less than 272 nm, such as some ultraviolet light, may cause photoelectric emission of electrons from the tungsten in the electron emitting block 402. Total electron emission may be increased where thermionic and photoelectric emission occurs. Accordingly, the wavelength of the laser 430 may be selected based on the type of material used in the electron emitting block 402, or the type of material used in the electron emitting block 402 may be selected based on the wavelength of the laser 430. In either case, the wavelength of the electromagnetic radiation emitted from the laser 430 may be less than the photoelectric threshold (e.g., the threshold wavelength that causes photoelectric electron emission) of a material, such as the primary or majority material, used to make the electron emitting block 402. In some examples, the material is the primary or majority material used to make the electron emitting block 402.

Due a voltage difference between the cathode assembly and the anode 410, the electrons emitted from the electron emitting block 402 are accelerated towards the anode 410. The accelerated electrons form an electron beam 408 that travel along an electron beam path. The electron beam 408 impacts the anode 410, which causes the emission of x-rays 414 from the anode 410. The x-rays 414 exit the x-ray tube body 401 through a tube window 416. The x-rays 414 that exit through the window 416 form the x-ray beam that is used for imaging, such as x-ray beam 120 discussed above with reference to FIGS. 1A-1B.

The area in which the electron beam 408 impacts the anode 410 is referred to as the focal spot 412, as discussed above. The size, shape, and location of the focal spot 412 may be altered by altering the focusing cup 406. For example, modifying the size, shape, position, charge, and/or charge distribution of the focusing cup 406 may alter the electron beam 408 to form a desired focal spot 412. In addition, the spot size of the laser beam 431 may also alter the focal spot 412. For instance, a larger spot size of the laser beam 431 may result in a larger focal spot 412. In addition electrodes and a control signal, such as those discussed above, may also be incorporated into the x-ray tube 400 to further manipulate the electron beam 408 and the focal spot 412.

Figure 5:
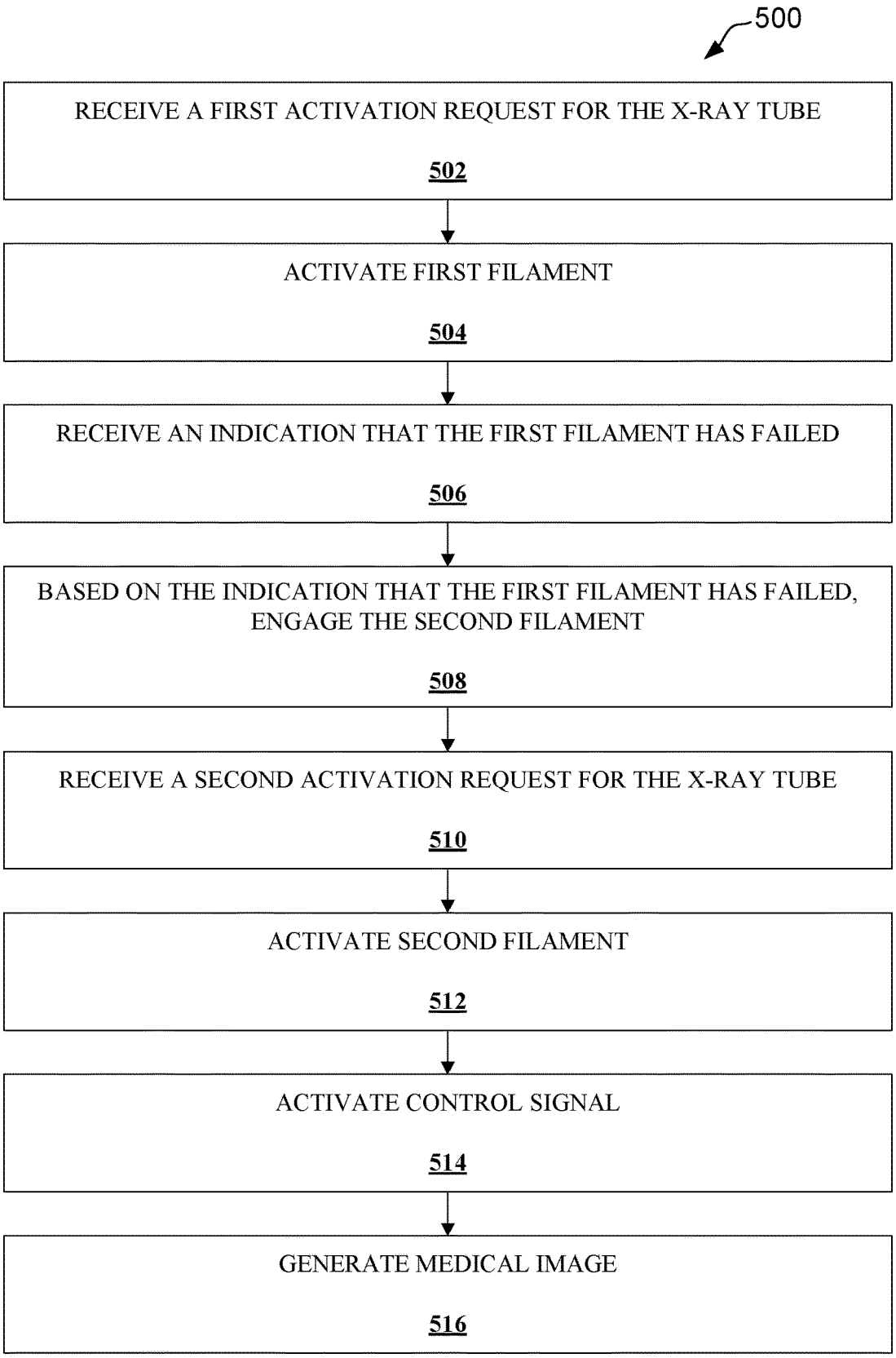
FIG. 5 depicts an example method for controlling an x-ray tube.

FIG. 5 depicts an example method 500 for controlling an x-ray tube. At operation 502, a first activation request for the x-ray tube is received. The first activation request may be a request to generate x-rays for imaging a patient. For example, the activation request may be generated when a mammography image or a tomography projection image is to be acquired. In response to receiving the first activation request for the x-ray tube, a first filament in the x-ray tube is activated at operation 504. Activating the first filament may include applying a voltage across the first filament. When the first filament is in a non-failed state, application of the voltage across the first filament causes a current to flow through the first filament. The current heats the first filament and may cause thermionic emission of electrons from the first filament. As discussed above, the emitted electrons from the first filament accelerate towards an anode of the x-ray tube which causes the production of the x-rays. The x-rays that leave the x-ray tube through an x-ray tube window form a first x-ray imaging beam. Activation of the first filament may also include additional operations such as activating additional components of the medical imaging system or the x-ray tube, such as establishing a high voltage difference between the cathode assembly and the anode of the x-ray tube.

At operation 506, an indication is received that the first filament has failed. The first filament may fail for multiple reasons. When the filament fails, however, the first filament generally creates an open circuit or abnormally high resistance between the terminals of the filament. Thus, current is effectively prevented from flowing through the first filament. The lack of current flowing when a voltage is applied across the failed first filament may be detected and used as a trigger signal, which may be the indication received in operation 506. The trigger signal may also be generated based on, or be representative of, an abnormally high resistance of the failed first filament. The indication that the first filament has failed may also generate a warning, such as a visual or audible indicator, for the technician.

At operation 508, a back-up or second filament of the x-ray tube is engaged based on the indication that the first filament has failed. The back-up or second filament of the x-ray tube may have substantially the same size and shape as the first filament. Engaging the second filament may include processing the trigger signal by software or firmware in a medical imaging system, which may then cause the second filament to engage via a switching mechanism. The trigger signal may also be used to engage the second filament without the use of software or firmware. For instance, the trigger signal may be provided to one or more transistors and/or relays that switch the connection of the voltage source from the terminals of the first filament to the terminals of the second filament. In addition, a mechanical switch may also be utilized to engage the second filament. The mechanical switch may be switched automatically or manually. For example, a technician, upon seeing or hearing an indicator that the first filament has failed, may switch the mechanical switch to engage the second filament.

At operation 510, a second request for activation of the x-ray tube is received. The second request may be similar to the first request that was received in operation 502. For example, the second activation request may be a request to generate x-rays for imaging a patient. For example, the second activation request may be generated when a subsequent mammography image or a subsequent tomography projection image is to be acquired. At operation 512, in response to receiving the second activation request for the x-ray tube, the second filament is activated at operation 504. Activation of the second filament may be similar to activation of the first filament. For example, activating the second filament may include applying a voltage across the second filament. Application of the voltage across the second filament causes a current to flow through the second filament. The current heats the second filament and may cause thermionic emission of electrons from the second filament. As discussed above, the emitted electrons from the second filament accelerate towards an anode of the x-ray tube which causes the production of the x-rays. The x-rays that leave the x-ray tube through an x-ray tube window form a second x-ray imaging beam. The second imaging beam may substantially similar to, if not the same as, the first imaging beam generating from activating the first filament. As discussed above, the electron beams produced by the first filament and the second filament may be manipulated such that the focal spot for both electron beams is the substantially the same. Accordingly, the x-ray imaging beams produced by the electron beams may be substantially the same.

At operation 514, a control signal may be applied across at least one pair of electrodes positioned opposite an electron beam path of the x-ray tube. The control signal may manipulate the electron beam produced by the second filament, as discussed above. In some examples, the control signal may be activated concurrently with the activation of the second filament in operation 512. At operation 516, a medical image may be generated based on the second x-ray imaging beam. For example, the second x-ray imaging beam may be detected by a detector or receptor after passing through a portion of a patient. The detector may convert the attenuated second x-ray beam into an electrical signal that is then converted to a medical image.

Figure 6:
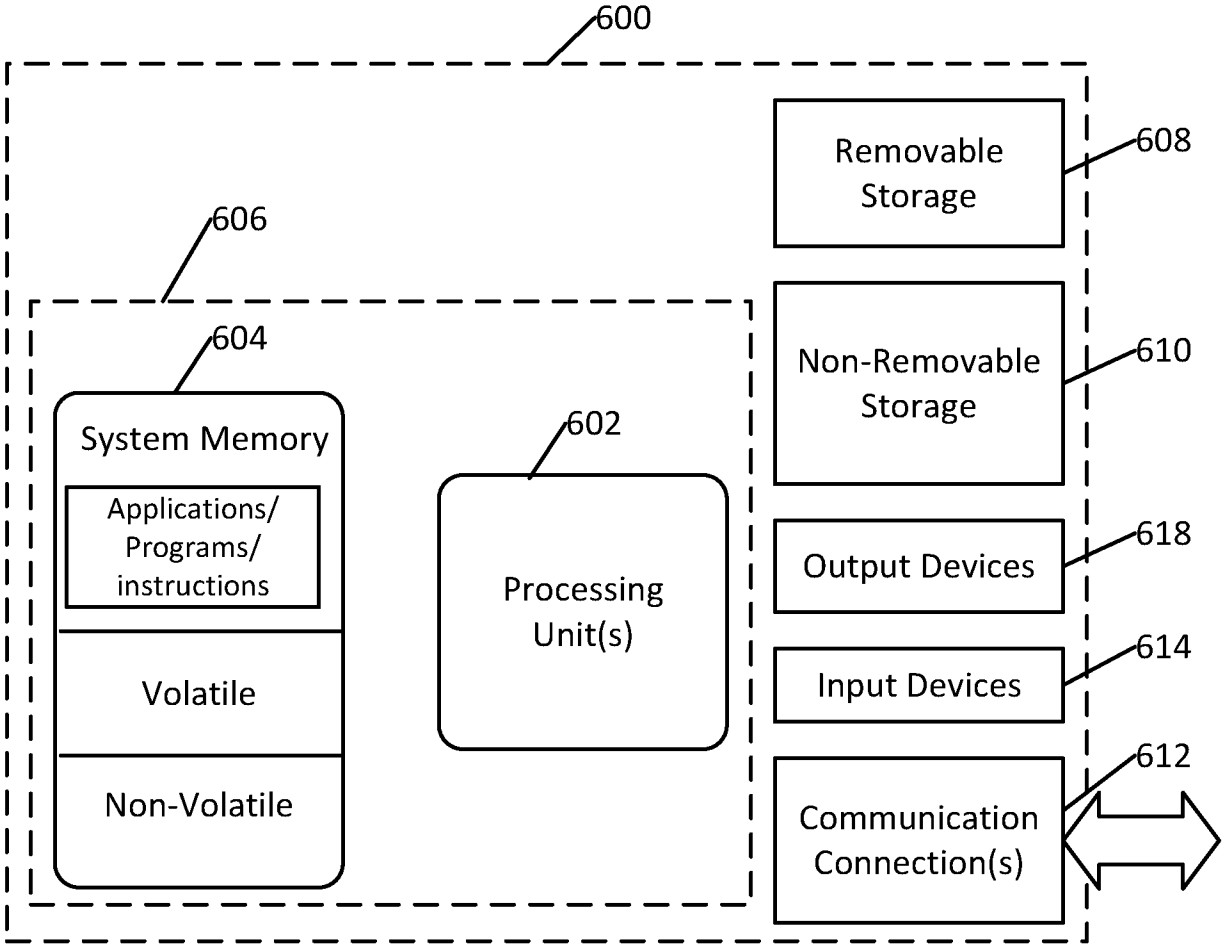
FIG. 6 depicts an example of a suitable operating environment for use with the present examples.

FIG. 6 illustrates an exemplary suitable operating environment for controlling an x-ray tube. In its most basic configuration, operating environment 600 typically includes at least one processing unit 602 and memory 604. Depending on the exact configuration and type of computing device, memory 604 (storing, instructions to perform the x-ray tube control techniques disclosed herein) may be volatile (such as RAM), non-volatile (such as ROM, flash memory, etc.), or some combination of the two. This most basic configuration is illustrated in FIG. 6 by dashed line 606. Further, environment 600 may also include storage devices (removable, 608, and/or non-removable, 610) including, but not limited to, solid-state, magnetic or optical disks, or tape. Similarly, environment 600 may also have input device(s) 614 such as keyboard, mouse, pen, voice input, etc. and/or output device(s) 616 such as a display, speakers, printer, etc. Also included in the environment may be one or more communication connections 612, such as LAN, WAN, point to point, etc. In embodiments, the connections may be operable to facility point-to-point communications, connection-oriented communications, connectionless communications, etc.

Operating environment 600 typically includes at least some form of computer readable media. Computer readable media can be any available media that can be accessed by processing unit 602 or other devices comprising the operating environment. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other non-transitory medium which can be used to store the desired information. Computer storage media does not include communication media.

Communication media embodies computer readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, microwave, and other wireless media. Combinations of any of the above should also be included within the scope of computer readable media.

The operating environment 600 may be a single computer operating in a networked environment using logical connections to one or more remote computers. The remote computer may be a personal computer, a server, a router, a network PC, a peer device or other common network node, and typically includes many or all of the elements described above as well as others not so mentioned. The logical connections may include any method supported by available communications media. Such networking environments are commonplace in offices, enterprise-wide computer networks, intranets and the Internet.

The embodiments described herein may be employed using software, hardware, or a combination of software and hardware to implement and perform the systems and methods disclosed herein. Although specific devices have been recited throughout the disclosure as performing specific functions, one of skill in the art will appreciate that these devices are provided for illustrative purposes, and other devices may be employed to perform the functionality disclosed herein without departing from the scope of the disclosure. In addition, some aspects of the present disclosure are described above with reference to block diagrams and/or operational illustrations of systems and methods according to aspects of this disclosure. The functions, operations, and/or acts noted in the blocks may occur out of the order that is shown in any respective flowchart. For example, two blocks shown in succession may in fact be executed or performed substantially concurrently or in reverse order, depending on the functionality and implementation involved.

This disclosure describes some embodiments of the present technology with reference to the accompanying drawings, in which only some of the possible embodiments were shown. For instance, while the present disclosure primarily discussed having only one backup filament, additional backup filaments may also be included in the x-ray tube to further prolong the lifetime of the x-ray tube. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art. Further, as used herein and in the claims, the phrase "at least one of element A, element B, or element C" is intended to convey any of: element A, element B, element C, elements A and B, elements A and C, elements B and C, and elements A, B, and C. Further, one having skill in the art will understand the degree to which terms such as "about" or "substantially" convey in light of the measurements techniques utilized herein. To the extent such terms may not be clearly defined or understood by one having skill in the art, the term "about" shall mean plus or minus ten percent.

Although specific embodiments are described herein, the scope of the technology is not limited to those specific embodiments. One skilled in the art will recognize other embodiments or improvements that are within the scope and spirit of the present technology. In addition, one having skill in the art will recognize that the various examples and embodiments described herein may be combined with one another. Therefore, the specific structure, acts, or media are disclosed only as illustrative embodiments. The scope of the technology is defined by the following claims and any equivalents therein.

What is claimed is:

1. An x-ray tube comprising:

a focusing cup;

an anode;

a first filament positioned in a first location between the focusing cup and the anode, the first filament having a first size;

a second filament positioned in a second location between the focusing cup and anode, the second filament having a second size that is substantially the same as the first size;

a switching mechanism configured to engage the second filament upon failure of the first filament; and a first electrode and a second electrode positioned between the focusing cup and the anode, wherein the first electrode is positioned opposite an electron beam path from the second electrode, wherein the first electrode and the second electrode are configured to:

when a first control signal is applied across the first and second electrode, generate an electric field that moves a first electron beam generated from the first filament in a first direction, and when a second control signal is applied across the first and second electrode, generate an electric field that moves a second electron beam generated from the second filament in a second direction.

2. The x-ray tube of claim 1, wherein:

the first filament is configured to generate the first electron beam having a first focal spot on the anode;

the second filament is configured to generate the second electron beam; and the first control signal is configured to move the second electron beam such that the second electron beam has a second focal spot on the anode that is substantially the same as the first focal spot.

3. The x-ray tube of claim 2, further comprising a third electrode and a fourth electrode, wherein the third electrode and the fourth electrode are configured to, when a second control signal is applied across the third and the fourth electrode, generate an electric field that moves the electron beam in a second direction.

4. The x-ray tube of claim 1, wherein the switching mechanism is a mechanical switch.

5. The x-ray tube of claim 1, wherein the switching mechanism includes at least one transistor or relay configured to automatically engage the second filament upon the failure of the first filament.

6. An x-ray tube comprising:

a first focusing cup;

a second focusing cup;

an anode;

a first filament located between the first focusing cup and the anode;

a second filament positioned between the second focusing cup and the anode;

a switching mechanism configured to engage the second filament upon failure of the first filament; and a first electrode and a second electrode positioned between both (1) the first focusing cup and the second focusing cup and (2) the anode, wherein the first electrode is positioned opposite an electron beam path from the second electrode, wherein the first electrode and the second electrode are configured to:

when a first control signal is applied across the first electrode and the second electrode, generate a first electric field that moves a first electron beam generated from the first filament in a first direction, and when a second control signal is applied across the first electrode and the second electrode, generate a second electric field that moves a second electron beam generated from the second filament in a second direction.

7. The x-ray tube of claim 6, wherein:

the first filament is configured to generate the first electron beam having a first focal spot on the anode;

the second filament is configured to generate the second electron beam; and the first control signal is configured to move the second electron beam such that the second electron beam has a second focal spot on the anode that is substantially the same as the first focal spot.

8. The x-ray tube of claim 6, wherein the first filament is configured to generate the first electron beam having a first focal spot on the anode;

the second filament is configured to generate the second electron beam; and the first focusing cup and the second focusing cup are positioned such that the second electron beam has a second focal spot on the anode that is substantially the same as the first focal spot.

9. The x-ray tube of claim 6, wherein the switching mechanism is a mechanical switch.

10. A method for producing x-rays from an x-ray tube, the method comprising:

receiving a first activation request for the x-ray tube;

activating a first filament in the x-ray tube to generate a first x-ray imaging beam;

receiving an indication that the first filament has failed;

based on the indication that the first filament has failed, engaging a second filament in the x-ray tube;

receiving a second activation request for the x-ray tube;

activating a second filament in the x-ray tube to generate a second x-ray imaging beam that is substantially similar the first x-ray imaging beam;

activating a first control signal applied across a pair of electrodes positioned opposite an electron beam path of both the first filament and the second filament to move a first electron beam generated from the first filament in a first direction; and activating a second control signal applied across the pair of electrodes to move a second electron beam generated from the second filament in a second direction.

11. The method of claim 10, wherein activating the first filament comprises applying a voltage across the first filament.

12. The method of claim 10, wherein activating the second filament comprises applying a voltage across the second filament.

13. The method of claim 10, wherein engaging the second filament comprises switching a mechanical switch.

14. The method of claim 10, wherein the indication that the first filament has failed is a trigger signal generated based on a high resistance of the first filament.

15. The method of claim 10, wherein the control signal is activated concurrently with the activation of the second filament.

* * * * *